US008090307B2

(12) United States Patent
Hoshino et al.

(10) Patent No.: US 8,090,307 B2
(45) Date of Patent: Jan. 3, 2012

(54) DEVELOPER RECOVERING UNIT WITH GROUNDED DOWNSTREAM TRANSPORTING DEVICE AND IMAGE FORMING APPARATUS USING THE SAME

(75) Inventors: Hirohisa Hoshino, Kanagawa (JP); Kiyoshi Kinno, Iwate (JP); Tatsuya Soga, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 255 days.

(21) Appl. No.: 12/477,454

(22) Filed: Jun. 3, 2009

(65) Prior Publication Data

US 2010/0119270 A1 May 13, 2010

(30) Foreign Application Priority Data

Nov. 7, 2008 (JP) ..... P2008-286160

(51) Int. Cl.
*G03G 21/00* (2006.01)

(52) U.S. Cl. ..... 399/358

(58) Field of Classification Search ..... 399/358, 399/359, 360

See application file for complete search history.

(56) References Cited

U.S. PATENT DOCUMENTS 5,400,127 A * 3/1995 Arai et al. ..... 399/71
2005/0220515 A1* 10/2005 Wakana ..... 399/358

FOREIGN PATENT DOCUMENTS

EP 899632 A2 * 3/1999
JP 5-313441 11/1993
JP 3747683 B 12/2005
JP 2006-133397 5/2006
JP 4076461 B 2/2008

* cited by examiner

*Primary Examiner* — David Gray
*Assistant Examiner* — Billy J Lactaoen
(74) *Attorney, Agent, or Firm* — Morgan, Lewis & Bockius LLP

(57) ABSTRACT

A developer recovering unit is provided with a recovery vessel that contains a developer to be recovered, a transporting device that includes a transporting member that transports the developer through a tubular transport path connecting a portion where the developer is generated to the recovery vessel, and a detecting device that detects an amount of the developer contained in the recovery vessel, wherein the transporting member is formed as a conductive member and is grounded at least in a most downstream section of the transport path connected to the recovery vessel.

15 Claims, 17 Drawing Sheets

DEVELOPER RECOVERING UNIT WITH GROUNDED DOWNSTREAM TRANSPORTING DEVICE AND IMAGE FORMING APPARATUS USING THE SAME

CROSS-REFERENCE TO RELATED APPLICATION

This application is based on and claims priority under 35 USC 119 from Japanese Patent Application No. 2008-286160 filed Nov. 7, 2008.

BACKGROUND

Technical Field

The present invention relates to a developer recovering unit and an image forming apparatus using the same.

SUMMARY

The developer recovering unit of this invention includes a recovery vessel that contains a developer to be recovered; a transporting device that includes a transporting member for transporting the developer through a tubular transport path connecting a portion where the developer is generated to the recovery vessel; and a detecting device that detects an amount of the developer contained in the recovery vessel, and the transporting member is formed as a conductive member and is grounded at least in a most downstream transport path section of the transporting device connected to the recovery vessel.

BRIEF DESCRIPTION OF THE DRAWINGS

Exemplary embodiments of the invention will be described in detail based on the following figures, wherein.

DETAILED DESCRIPTION

The present invention (hereinafter simply referred to as the exemplary embodiments) will now be described with reference to the accompanying drawings.

Exemplary Embodiment 1

Figure 1:
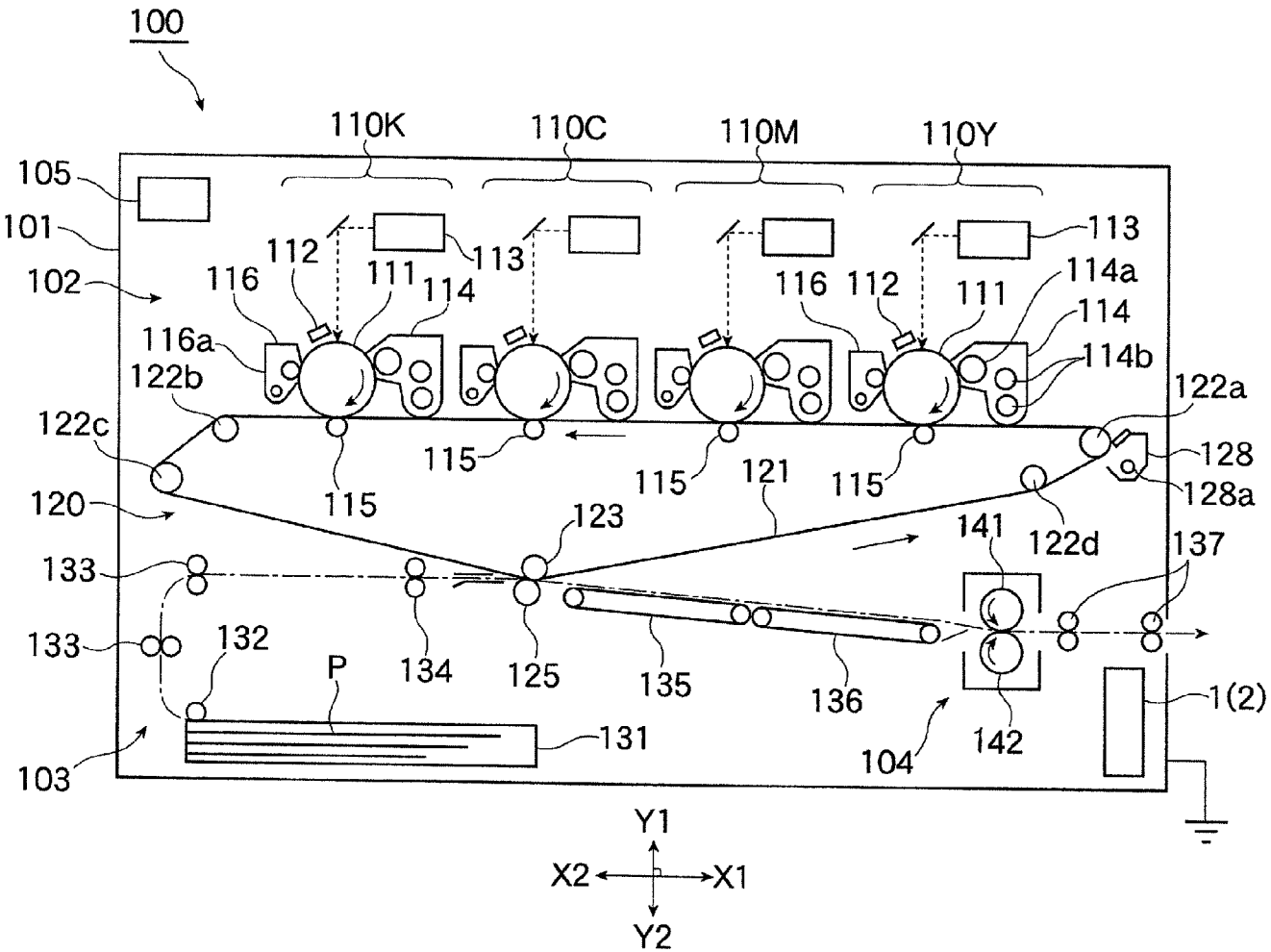
FIG. 1 is an explanatory diagram illustrating the outline of an image forming apparatus and the like according to Exemplary embodiment 1.
Figure 2:
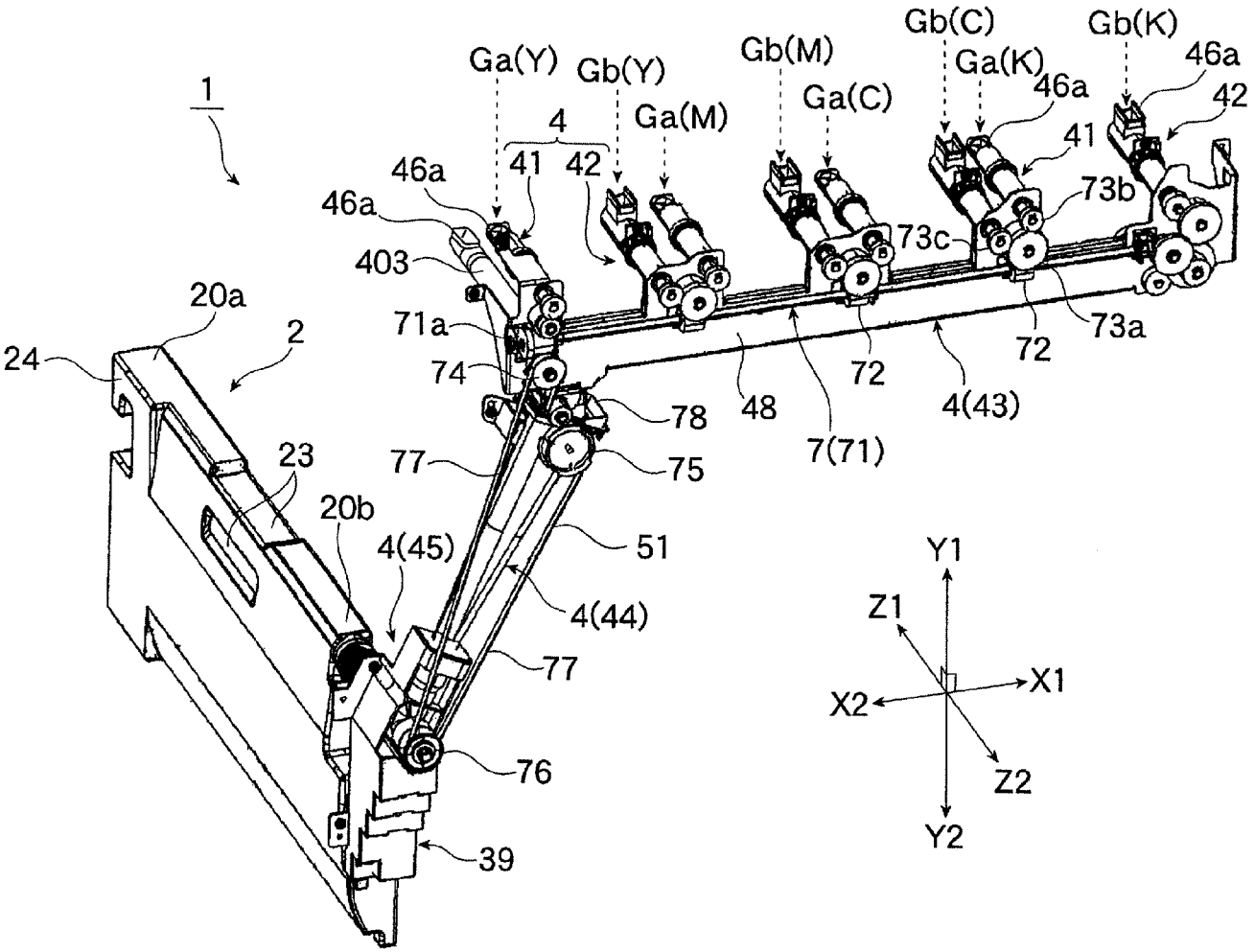
FIG. 2 is a perspective view of a developer recovering unit included in the image forming apparatus of FIG. 1.

FIGS. 1 and 2 illustrate an image forming apparatus and a developer recovering unit according to Exemplary embodiment 1, and specifically, FIG. 1 illustrates the entire image forming apparatus 100 and FIG. 2 illustrates the entire developer recovering unit 1.

As illustrated in FIG. 1, the image forming apparatus 100 mainly includes, in an internal space of a casing 101, an imaging device 102 for forming a toner image made of a toner, that is, a developer, and transferring the toner image onto a paper sheet P; a paper sheet feeding device 103 containing and feeding the paper sheet P to be used in the imaging device 102; and a fixing device 104 for fixing the toner image having been transferred by the imaging device 102 on the paper sheet P. The casing 101 is constructed by a supporting member, an external cover and the like, and the supporting member is grounded (namely, earthed). A reference numeral 105 used in FIG. 1 denotes a controller for controlling the operations and the like of the image forming apparatus 100 and the developer recovering unit 1, and an arrowed alternate long and short dash line corresponds to a main feeding path for feeding the paper sheet P.

The imaging device 102 includes plural of imaging units 110 for forming toner images of respective colors by utilizing, for example, a known electrophotographic method, and an intermediate transferring unit 120 for transferring, onto the paper sheet P, the toner images of the respective colors having been formed by the imaging units 110 after temporarily holding and supplying the toner images. In this exemplary embodiment, as the plural imaging units 110, four imaging units that respectively form toner images of yellow (Y), magenta (M), cyan (C) and black (K) are used.

The imaging units 110Y, 110M, 110C and 110K basically have a common structure, and each of them includes a photosensitive drum 111 rotatively driven in a direction shown with an arrow (that is, a clockwise direction in FIG. 1). Furthermore, these imaging units 110Y, 110M, 110C and 110K are arranged in parallel and spaced from one another so that the directions of the rotating shafts of the respective photosensitive drums 111 can be substantially parallel to one another.

Each of the imaging units 110Y, 110M, 110C and 110K has the following structure: A charging device 112 for charging a circumferential face, that is, an image forming area, of the photosensitive drum 111 at desired potential; an exposing device 113 for forming an electrostatic latent image (of the corresponding color component) with a potential difference by irradiating the surface of the photosensitive drum 111 with light based on image information (signal) after charging; a developing device 114 (Y, M, C or K) for developing the electrostatic latent image by allowing a toner of the corresponding color (of Y, M, C or K) to adhere onto the latent image; a primary transferring device 115 for transferring the toner image onto (an intermediate transferring belt 121 of) the intermediate transferring unit 120; and a first cleaning device 116 for removing a remaining portion of the toner and the like remaining on the surface of the photosensitive drum 111 after the transfer are mainly provided around the photosensitive drum 111.

Among these components of each imaging unit, the exposing device 113 performs the exposure on the basis of the image information obtained by executing desired processing, by an image processing device not shown, on image information input from an image creation source connected to or provided in the image forming apparatus 100, such as an original reading device, an external connection device or a recording medium reading device. Also, the developing device 114 uses, for example, a developer composed of a nonmagnetic toner and a magnetic carrier, and supplies the developer to a developing roll 114*a* to be supplied to a developing area opposing the photosensitive drum 111 while triboelectrically charging the toner by stirring the developer with a stirring supplying member 114*b* rotating in a container of the developer. Furthermore, in forming an image, the charging device 112, (the developing roll 114*a* of) the developing device 114 and the primary transferring device 115 are respectively supplied with a charging voltage, a developing voltage and a primary transferring voltage from a power supply unit not shown.

Moreover, the developing device 114 employs a developer supplying method in which a fresh developer G is supplied from a developer supplying device not shown at desired timing and the so-called trickle method in which an excessive portion of the developer (which portion is hereinafter referred to simply as the developer Ga) exceeding a precedently set amount is overflowed to discharge. Furthermore, the first cleaning device 116 includes a cleaning member, such as a blade or a rotating brush, disposed in contact with the photosensitive drum 111 for removing a remaining portion of the developer (mainly, the toner) remaining after the transfer, and the removed portion of the developer (which portion is hereinafter referred to simply as the developer Gb) and the like removed by the cleaning member is discharged by a discharging member 116*a* (See FIG. 1).

The intermediate transferring unit 120 mainly includes the intermediate transferring belt 121 running between the photosensitive drum 111 and the primary transferring device 115 of each imaging unit 110 (i.e., running through a primary transferring position) and rotating in a direction illustrated with arrows (that is, a counterclockwise direction in FIG. 1); plural of supporting rolls 122 and 123 for hanging and rotatably supporting the intermediate transferring belt 121 in a desired state; a secondary transferring roll 125 rotating in contact with a portion of the intermediate transferring belt 121 supported by the supporting roll 123; and a second cleaning device 128 for removing a remaining portion of the toner and the like remaining on the surface of the intermediate transferring belt 121 after the transfer.

Among these components, the intermediate transferring belt 121 is an endless belt made from a material obtained by dispersing a given amount of a conductive agent of carbon black or the like in a synthetic resin of polyimide, polyamide or the like. The supporting rolls 122 are constructed as driving rolls. In forming an image, a secondary transferring voltage is applied to the supporting roll 123 or the secondary transferring roll 125 by a power supply unit not shown. Furthermore, the second cleaning device 128 includes a cleaning member, such as a blade or a rotating brush, disposed in contact with the outer circumferential face of the intermediate transferring belt 121 for removing a remaining portion of the developer (mainly the toner) and the like remaining after the transfer, and the remaining portion of the developer (hereinafter referred to simply as the developer Gd) and the like removed by the cleaning member is discharged by a discharging member 128*a* (see FIG. 1).

In the paper sheet feeding device 103, plural of paper sheets P of a desired size and a desired type to be used for the image formation are stacked and contained in a paper container 131 of a tray type or a cassette type, and the paper sheets P contained in the paper container 131 are fed one by one by a feeding device 132. The paper container 131 is provided in plural in number in accordance with modes for using the image forming apparatus.

The fixing device 104 includes a heating rotation body 141 in the shape of a roll or a belt that is rotatively driven in a direction shown with an arrow and is heated to and kept at a given temperature on its surface by a heater; and a pressing rotation body 142 in the shape of a roll or a belt that is in contact with the heating rotation body 141 at a desired pressure substantially along its axial direction so as to be subordinately rotated.

In FIG. 1, reference numerals 133 and 134 denote paper feeding roll pairs provided in a paper feeding path formed between the paper container 131 of the paper feeding device 103 and a secondary transferring position (i.e., a portion between the intermediate transferring belt 121 and the secondary transferring roll 125). Also, reference numerals 135 and 136 denote feeding devices in the shape of a belt provided in a post-transfer feeding path formed between the secondary transferring position and the fixing device 104. Moreover, a reference numeral 137 denotes a paper feeding roll pair provided in a paper discharging path formed between the fixing device 104 and a side face of the casing 101.

In this image forming apparatus 100, an image is formed in a manner described below. In the following description, a basic image forming operation in which a color image formed by using the developer of the four colors, namely, what is called a full color image, is formed on one face of a paper sheet P will be exemplified:

When the controller 105 of the image forming apparatus 100 receives an instruction to start an image forming operation, the surface of the rotating photosensitive drum 111 is charged at desired potential with a desired polarity by the charging device 112 in each imaging unit 110 (Y, M, C or K) of the imaging device 102. Thereafter, the exposing device 113 exposes the charged photosensitive drum 111 on the basis of image information, so as to form an electrostatic latent image with a prescribed potential difference. Subsequently, when the electrostatic latent image passes through the developing device 114, the electrostatic latent image formed on the photosensitive drum 111 of each imaging unit 100 is developed with a toner, which is supplied from the developing roll 114*a* and has been charged at a desired polarity, and formed into a toner image. Thus, a toner image of each color component (of Y, M, C or K) is exclusively formed on the photosensitive drum 111 of the corresponding imaging unit 110 (Y, M, C or K).

Thereafter, when the toner images formed on the photosensitive drums 111 of the respective imaging units 110 (Y, M, C and K) are respectively transported to the primary transferring positions through the rotation of the photosensitive drums 111, the toner images are primarily transferred successively onto the intermediate transferring belt 121 of the intermediate transferring unit 120 of the imaging device 102 by the primary transferring devices 115 so as to overlap one another. When the multiple toner images thus transferred onto the intermediate transferring belt 121 are transported to the secondary transferring position, the toner images are secondarily transferred at the same time onto a paper sheet P fed from the paper feeding device 103 to the secondary transferring position through the paper feeding path at this timing. When the primary transfer and the secondary transfer are completed, the surfaces of the respective photosensitive drums 111 are cleaned by the first cleaning devices 116 in the respective imaging units 110, and the intermediate transferring belt 121 is cleaned by the second cleaning device 128 in the intermediate transferring unit 120.

Subsequently, the paper sheet P on which the toner images have been secondarily transferred is taken off from the intermediate transferring belt 121 and fed through the post-transfer feeding path to be introduced into the fixing device 104. In the fixing device 104, the paper sheet P on which the toner images have been transferred is heated and pressed by allowing it to pass through a contact portion between the heating rotation body 141 and the pressing rotation body 142, and thus, the toner included in the toner images is melted to be fixed on the paper sheet P. After this fixing, the paper sheet P is contained in a discharged paper container or the like not shown to be fed through a discharge feeding path.

In this manner, a full color image formed by using the toner of the four colors is formed on one face of one paper sheet P, and thus, the basic image forming operation is completed. When an instruction to perform the image forming operation plural of number of times is given, the aforementioned series of operations are similarly repeated in accordance with the instructed number of times.

Furthermore, in the image forming apparatus 100, during the image forming operation and the like, the developer Ga (Y, M, C or K) and the developer Gb (Y, M, C or K) are discharged from the developing device 114 and the first cleaning device 116 of each imaging unit 110 (Y, M, C or K). Also, the developer Gd is discharged from the second cleaning device 128 of the intermediate transferring unit 120. Therefore, the image forming apparatus 100 is provided with the developer recovering unit 1 for collectively recovering the developers Ga, Gb and Gd discharged from each developing device 114, each first cleaning device 116 and the second cleaning device 128.

Now, the developer recovering unit 1 will be described.

Figure 3:
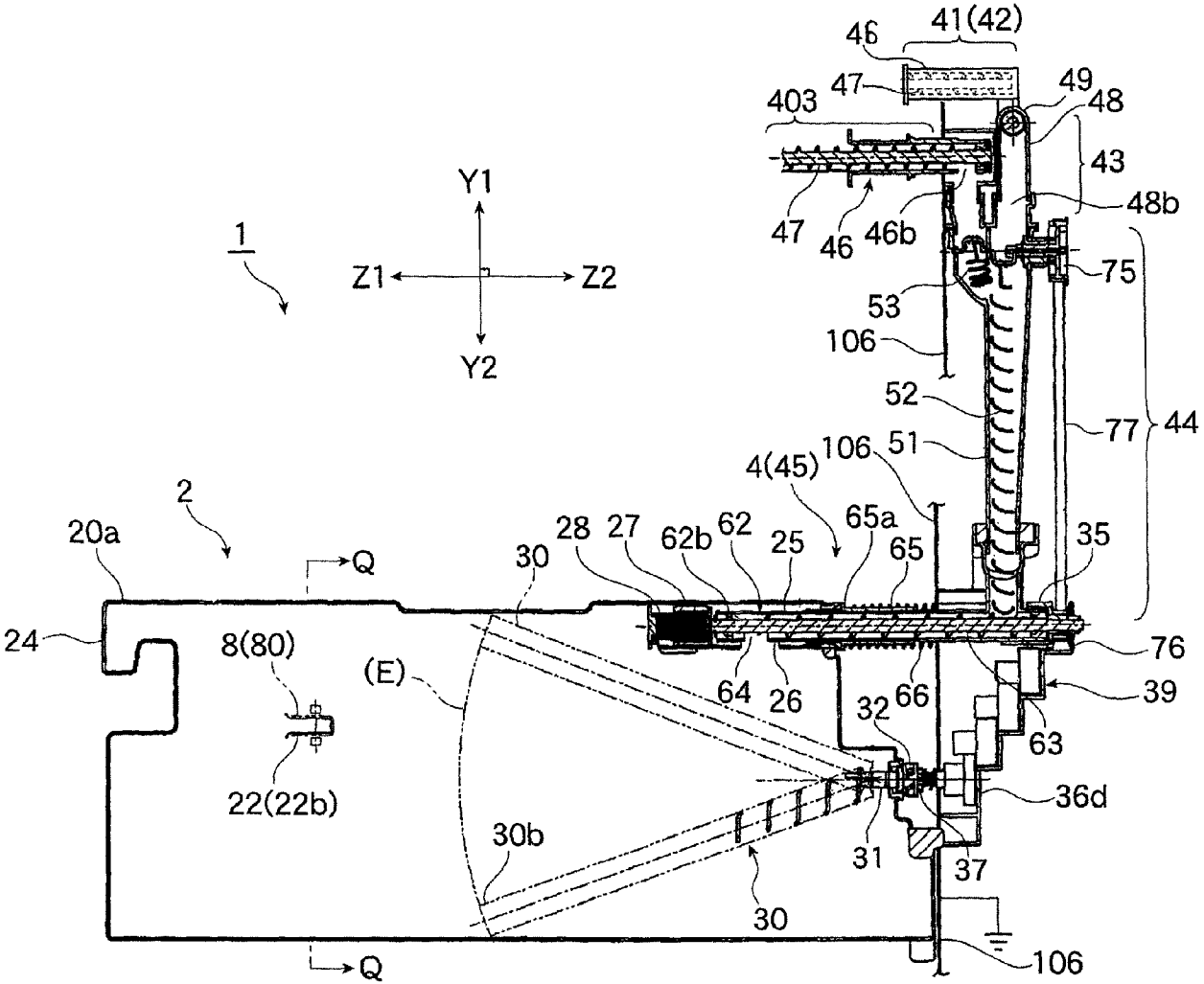
FIG. 3 is a schematic cross-sectional view of the developer recovering unit of FIG. 2.
Figure 4:
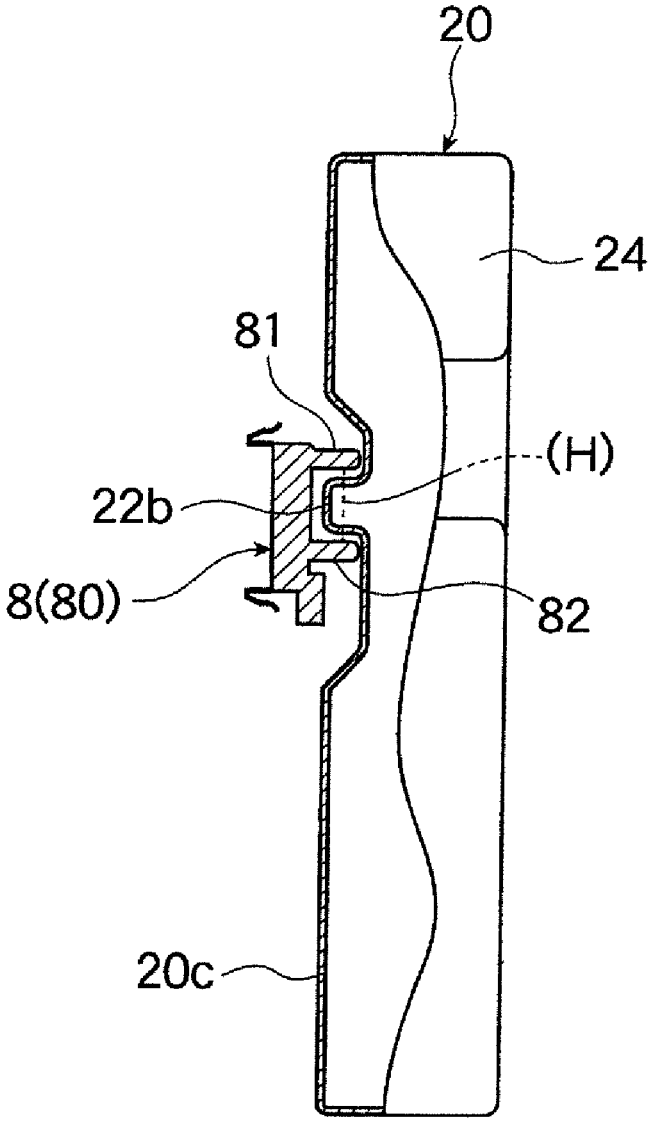
FIG. 4 is a cross-sectional view of the recovering unit (including a recovery vessel and a detecting device) taken on line Q-Q of FIG. 3.

The developer recovering unit 1 includes, as illustrated in FIGS. 2 through 4 and the like, a recovery vessel 2 for collectively keeping therein the developers Ga and Gb discharged from the respective imaging units 110 (Y, M, C and K); a transporting device 4 for connecting the developing devices 114 and the first cleaning devices 116, which discharge the developers Ga and Gb, and the recovery vessel 2 for transporting the developers Ga and Gb; and a detecting device 8 for detecting the amount of a mixture of the developers Ga and Gb (which mixture is hereinafter referred to simply as the developer Gc) kept and deposited in the recovery vessel 2. FIG. 3 is a cross-sectional view of the recovery vessel 2 and a part of the transporting device 3 of the developer recovering unit of FIG. 2, and FIG. 4 is a cross-sectional view taken on line Q-Q of a part of FIG. 3.

The recovery vessel 2 includes a vessel body 20 having a substantially rectangular parallelepiped appearance, and is removably provided in an loading space formed in a part of the casing 101 of the image forming apparatus 100 (in a lower end part close to the fixing device 104) as illustrated in FIG. 1 so as to be loaded or removed in a direction, for example, shown with arrows Z1 and Z2.

Figure 6:
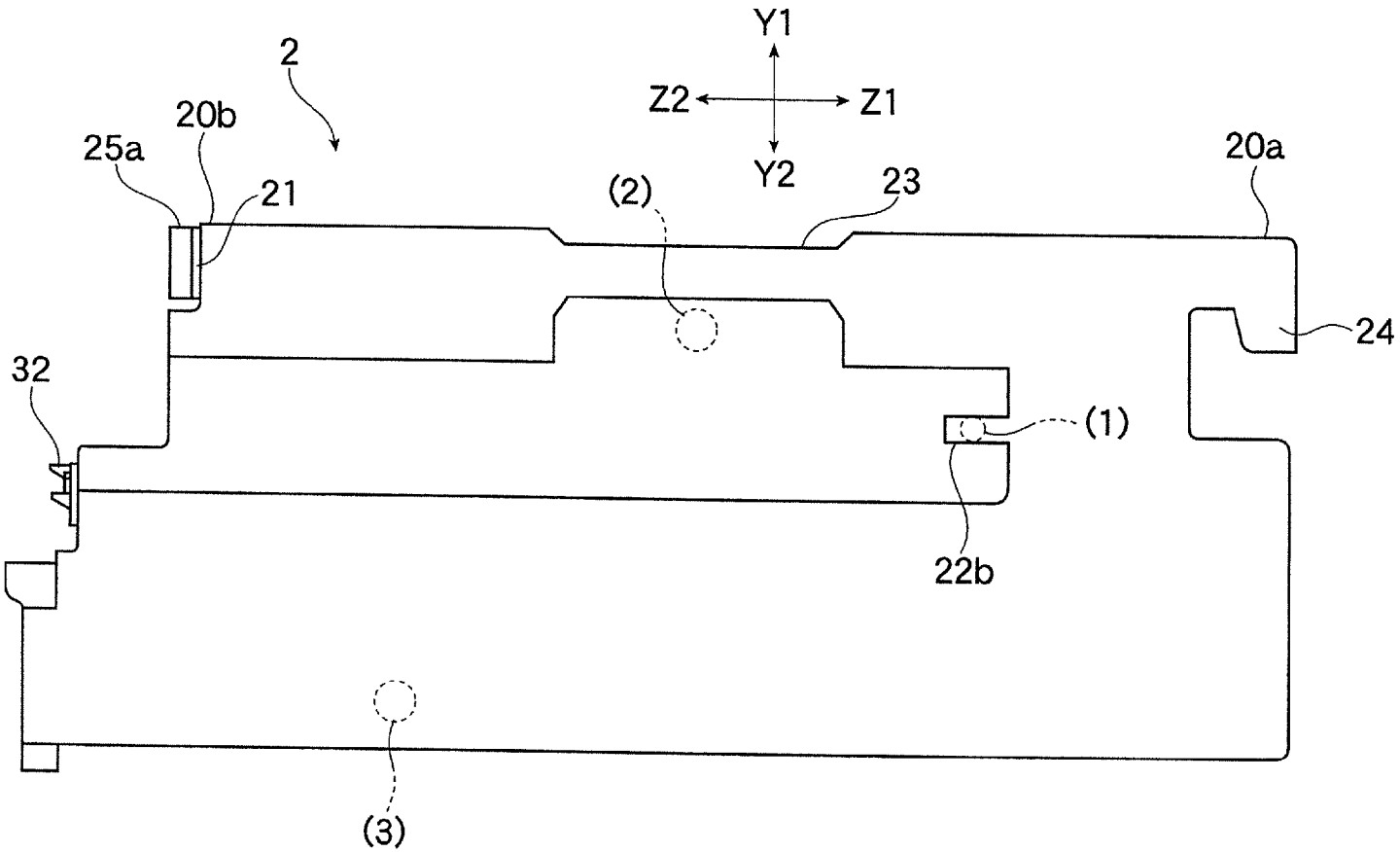
FIG. 6 is a side view illustrating the appearances of the recovery vessel of the recovering unit of FIG. 3.
Figure 7:
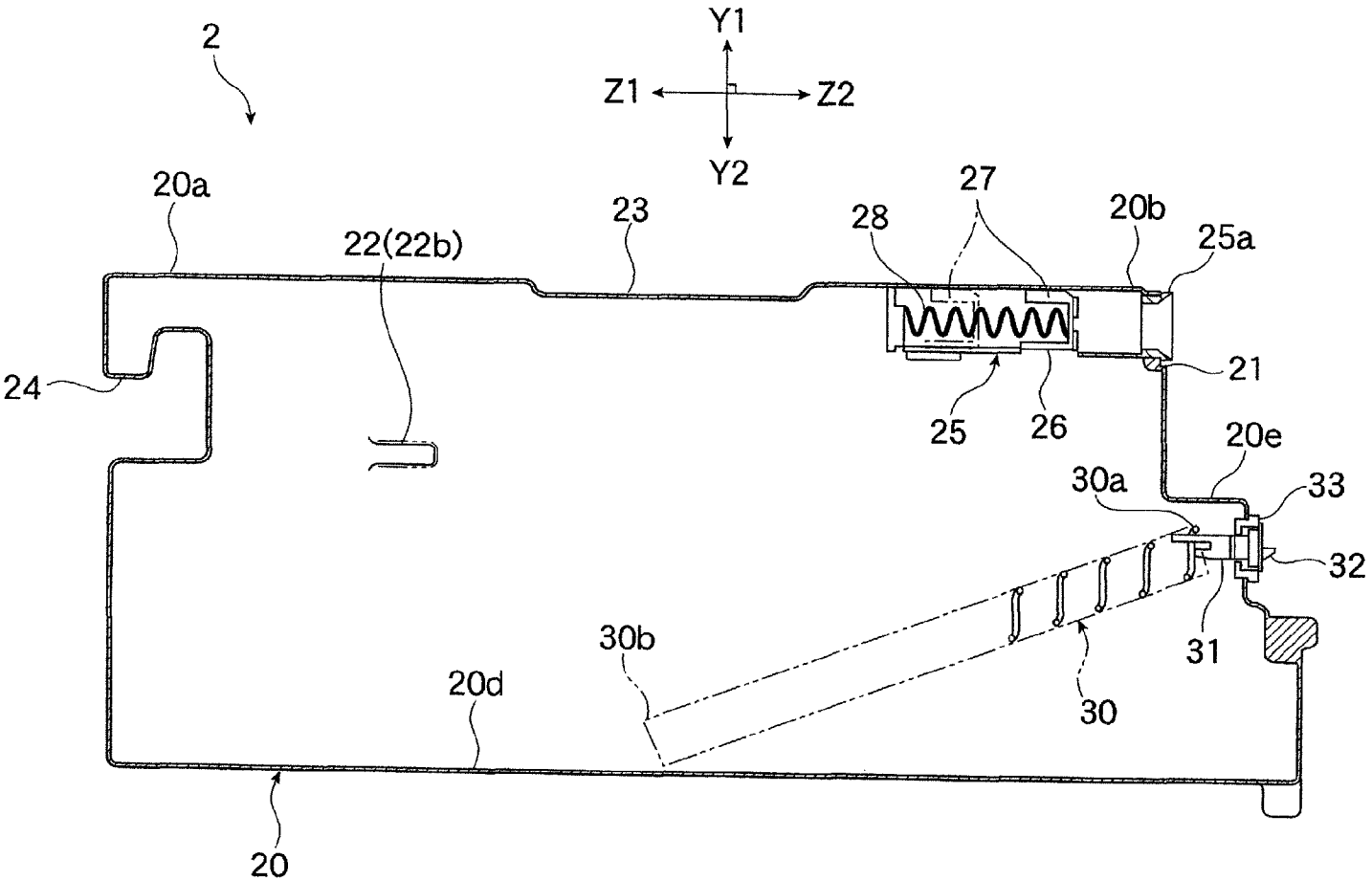
FIG. 7 is a cross-sectional view of the recovery vessel of FIG. 4.

The recovery vessel 2 has an inlet 21 for receiving the developer to be recovered on a side face of an inner end portion 20*b*, which is an upper portion of the vessel body 20 and is positioned on the inner side when the vessel is loaded. Also, as illustrated in FIGS. 4, 6 and the like, a detecting/measuring part 22 where the detection by the detecting device 8 is performed is formed in a prescribed position on one side face 20*c* of the vessel body 20. In the detecting/measuring part 22, a detecting projection portion 22*b* in a shape protruding and projecting toward the outside of the vessel is formed at an end portion of the vessel body 20 positioned on the outer side when the vessel is loaded. The position of the detecting/measuring part 22 is one suitable for detecting that the amount of the developer Gc contained in the vessel body 20 has reached a set amount. In FIGS. 2, 6, 7 and the like, a reference numeral 23 denotes a grip (a recess) to be grasped in carrying the recovery vessel 2, and a reference numeral 24 denotes a handle to be used in loading/removing the recovery vessel 2.

At this point, the detecting device 8 is constructed for detecting that the amount of the developer Gc contained and deposited in the recovery vessel 2 has reached the set amount. Such a detecting device 8 is constructed, as illustrated in FIG. 4, by using an optical type detector (i.e., what is called a photosensor) 80 including a light emitting part 81 and a light receiving part 82 disposed so as to sandwich the projection portion 22*b* of the detecting/measuring part 22. In this optical type detector 80, detection light H emitted from the light emitting part 81 passes through the projection portion 22*b* of the detecting/measuring part 22 and its internal space (i.e., the inside of the vessel) and is received by the light receiving part 82, so as to detect change of the quantity of received light (i.e., quantitative change of the light). This detector 80 is fixedly provided on the casing 101 or the like of the image forming apparatus. Also, detection information obtained by the detector 80 is sent to the controller 105.

In this detector 80, when the developer Gc to be recovered is contained in the recovery vessel 2 (specifically, the vessel body 20) and deposited up to such a level as to fill the internal space of the projection portion 22*b* of the detecting/measuring part 22, the detection light H is gradually blocked by the deposited developer, resulting in changing the quantity of light received by the light receiving part 82. When the quantity of light thus obtained falls below a set value, the detector 80 detects that the amount of the developer Gc contained in the recovery vessel 2 has reached the set amount (for example, an amount at which it should be informed that the recovery vessel 2 is full and should be exchanged). It is determined by the controller 105 whether or not the amount of the developer has reached the set amount.

The vessel body 20 is fabricated by molding a synthetic resin such as polypropylene into a desired shape by blow molding or the like. When the optical type detector 80 is used as the detecting device 8, the vessel body 20 is formed to have transparency sufficient for allowing the detection light H to transmit at least in the detecting/measuring part 22 (the projection portion 22*b* in particular). Furthermore, since the vessel body 20 is a molded substance fabricated by using the synthetic resin as described above, it has an electronic insulating property as a whole.

Furthermore, the recovery vessel 2 is provided with a conveyor pipe receiver/holder 25 disposed to extent from the inlet 21 toward the inside of the vessel. The conveyor pipe receiver/holder 25 holds a most downstream conveyor pipe 62, described later, of the transporting device 4 inserted into the vessel body 20 when the recovery vessel 2 is loaded.

The conveyor pipe receiver/holder 25 is formed as a tubular structure, for example, having an inner diameter sufficient for inserting the conveyor pipe 62, and is attached in such a manner that its one end portion 25*a* is partly exposed outside the vessel at the inlet 21. Furthermore, the conveyor pipe receiver/holder 25 has, on its lower face at substantially the center, an introducing port 26 through which the developer G transported and discharged through the conveyor pipe 62 is dropped and introduced into the inside of the vessel body 20.

A portion of the conveyor pipe receiver/holder 25 disposed further inward from the introducing port 26 is provided with a closing shutter 27 for opening/closing the introducing port 26 by moving within the conveyor pipe receiver/holder 25 along the lengthwise direction (i.e., the direction shown with the arrows Z1 and Z2). When the recovery vessel 2 is not loaded, the closing shutter 27 is moved to a position for closing the introducing port 26 by elastically pushed by an elastic member 28 of a coil spring or the like toward the inlet 21 (i.e., the direction shown with the arrow Z2) as illustrated in FIG. 7. Alternatively, when the recovery vessel 2 is loaded, the closing shutter 27 is moved to a position for opening the introducing port 26 because it is pushed in a direction away from the inlet 21 (i.e., the direction shown with the arrow Z1) against the pushing force of the elastic member 28 due to the insertion of the conveyor pipe 62 (see FIG. 3).

Moreover, the recovery vessel 2 is provided, as illustrated in FIGS. 3 and 7, with an inside transporting member 30 present inside the vessel body 20 for transporting the developer Gc kept in the vessel body 20 within the vessel. As the inside transporting member 30, a structure obtained by spirally winding a metal wire of, for example, stainless steel is used.

One end portion 30*a* of the inside transporting member 30 is supported on an upper portion of a side face of a lower projection portion 20*e*, which is formed by protruding, along a direction for inserting the recovery vessel 2 in loading (i.e., the direction of the arrow Z2), a substantially lower half of a side face of the end portion 20*b* disposed on the side of the inlet 21 of the vessel body 20. Specifically, the one end portion 30*a* of the inside transporting member 30 is inserted into an attachment hole of a supporting shaft 31 rotatably provided via a bearing 33 (second bearing) on the upper portion of the side face of the lower projection portion 20*e* with a space kept therebetween. A part of the bearing 33 is attached to be exposed outside the lower projection portion 20*e* of the vessel body 20. Furthermore, the inside transporting member 30 has a length sufficiently reaching the center along the lengthwise direction of the inside of the vessel body 20 and has another end portion 30*b* as a free end supported by nothing. The supporting shaft 31 is provided, at its end opposite to the side supporting the inside transporting member 30, with a contact type shaft coupler (what is called a coupling member) 32 having a projection in contact with and connected in an engaged state to a projection of a shaft coupler 37 of a rotation drive transmission mechanism described later.

Furthermore, the inside transporting member 30 is supported inside the vessel body 20 in an open-sided manner, so that its one end 30*b* can nod by vertically displacing within the vessel body 20. Therefore, when the developer Gc is not contained in the vessel body 20 (as illustrated in FIG. 7), the inside transporting member 30 is hung in a state where the free end 30*b* points down due to its own weight and is in contact with an inside bottom 20*d* of the vessel body 20. Alternatively, when the developer Gc is present and contained in the vessel body 20 (as illustrated in FIG. 3), the free end 30*b* is gradually moved to displace upward within the vessel body 20 in accordance with the amount of the developer Gc kept therein (see FIG. 3). A curve E of an alternate long and two short dashed line shown in FIG. 3 corresponds to the locus of the free end 30*b* of the inside transporting member 30 obtained through the vertical displacement. Furthermore, since the inside transporting member 30 is rotated in a prescribed direction by receiving a rotation drive force, a transporting force for transporting the developer Gc contained within the vessel body 20 from the side of the supported end 30*a* toward the side of the free end 30*b* is generated.

The transporting device 4 includes, as illustrated in FIGS. 2 and 3, plural of transporting parts (transport path sections) 41 through 45 in which the direction for transporting the developer is changed by switching.

In this exemplary embodiment, the transporting device includes three kinds of first transporting parts 41, 42 and 403 that receive the developers Ga, Gb and Gd discharged from the developing device 114 and the first cleaning device 116 of each imaging unit 110 (Y, M, C or K) and the second cleaning device 128 and transport the received developers in an inward direction (i.e., the direction of the arrow Z2) of the developer recovering unit 1 (or the image forming apparatus 100); a second transporting part 43 that collects the developers Ga, Gb and Gd having been transported through the first transporting parts 41, 42 and 403 and transports the collected developers in the same direction; a third transporting part 44 that transports a developer Ge, that is, the developers Ga, Gb and Gd having been collected and mixed in the second transporting part 43, in a downward direction toward the recovery vessel 2; and a fourth transporting part 45 that transports the developer Ge having been transported by the third transporting part 44 ultimately to the recovery vessel 2. These transporting parts 41 through 45 and 403 (specifically, conveyor pipes, a drive transferring mechanism and the like included therein) are arranged in the casing 101 of the image forming apparatus on a side close to its rear face when it is installed and are attached to be fixed on the supporting members such as supporting frames corresponding to a part of the casing 101.

Each of the first transporting parts 41, 42 and 403 is, as illustrated in FIG. 3, composed of a cylindrical first conveyor pipe 46 disposed in substantially a horizontal state; and an auger 47 (that is, a transporting member obtained by spirally winding a conveyor blade (a projected streak) around a rotating shaft) for transporting the developer Ga, Gb or Gd in the direction shown with the arrow Z2 by rotating within the conveyor space of the first conveyor pipe 46. A reference numeral 46*a* used in FIG. 2 denotes an inlet provided at an upstream end along the transporting direction (i.e., the direction of the arrow Z2) of each first conveyor pipe 46 for receiving the developer Ga, Gb or Gd discharged from the developing device 114, the first cleaning device 116 or the second cleaning device 128. Also, a reference numeral 46*b* used in FIG. 3 denotes a discharge port for discharging the developer having been transported through the first conveyor pipe 46.

The second transporting part 43 includes, as illustrated in FIGS. 2 and 3, a cylindrical second conveyor pipe 48 that is connected to each discharge port 46*b* of each conveyor pipe 46 of the first transporting parts 41 and 42 and is disposed in substantially a horizontal state; and an auger 49 for transporting the developer Ga or Gb in the direction shown with the arrow X2 by rotating in the conveyor space of the second conveyor pipe 48. A reference numeral 48*b* used in FIG. 3 denotes a discharge port formed in a lower portion of a downstream end along the transporting direction (i.e., the direction of the arrow X2) of the second conveyor pipe 48 for discharging the developer.

Figure 5:
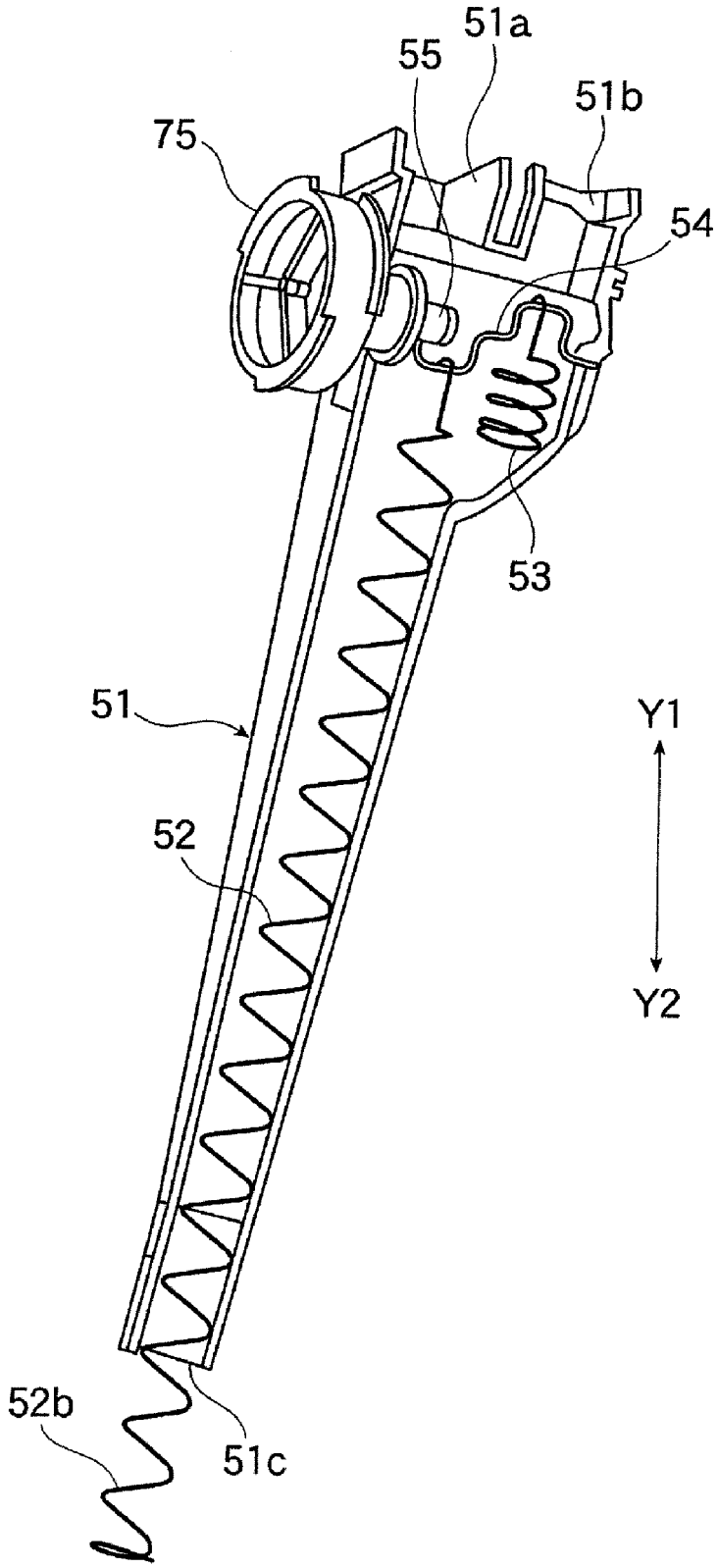
FIG. 5 is a cross-sectional view of a part (a third transporting part) of a transporting device of the recovering unit of FIG. 3.

The third transporting part 44 includes, as illustrated in FIGS. 2, 3 and 5, a tubular third conveyor pipe 51 connected to the downstream end (discharge port) of the second conveyor pipe 48 of the second transporting part 43 and extending diagonally downward to a position close to the inner end portion 20*b* of the recovery vessel 2 disposed in a position lower than the second conveyor pipe 48; and vertically moving loosening coils 52 and 53 that are driven to be vertically displaced in the conveyor space of the third conveyor pipe 51 for guiding the developer Ga or Gb supplied from the second transporting part 43 to drop while loosening aggregation of the developer. Reference numerals 51*a* and 51*b* used in FIG. 5 denote receiving openings for receiving the developers Ga or Gb and Gd discharged from the second conveyor pipe 48, and a reference numeral 51*c* denotes a discharge opening for the developer.

The vertically moving loosening coils 52 and 53 are attached with their upper ends hung from crank horizontal portions of a crank shaft 54 rotating in an upper tubular portion of the third conveyor pipe 51, whereby vertically moving (reciprocating) in a direction illustrated with arrows Y1 and Y2 within the third conveyor pipe 51. One end of the crank shaft 54 is attached on a rotation supporting shaft 55 provided in an upper portion of the third conveyor pipe 51, so as to obtain the rotatory power. A lower end 52*b* of the vertically moving loosening coil 52 protrudes from the discharge opening 51*c* disposed at the lower end of the third conveyor pipe 51, so as to work within a connecting pipe 61 of the fourth transporting part 45 described later.

Figure 8:
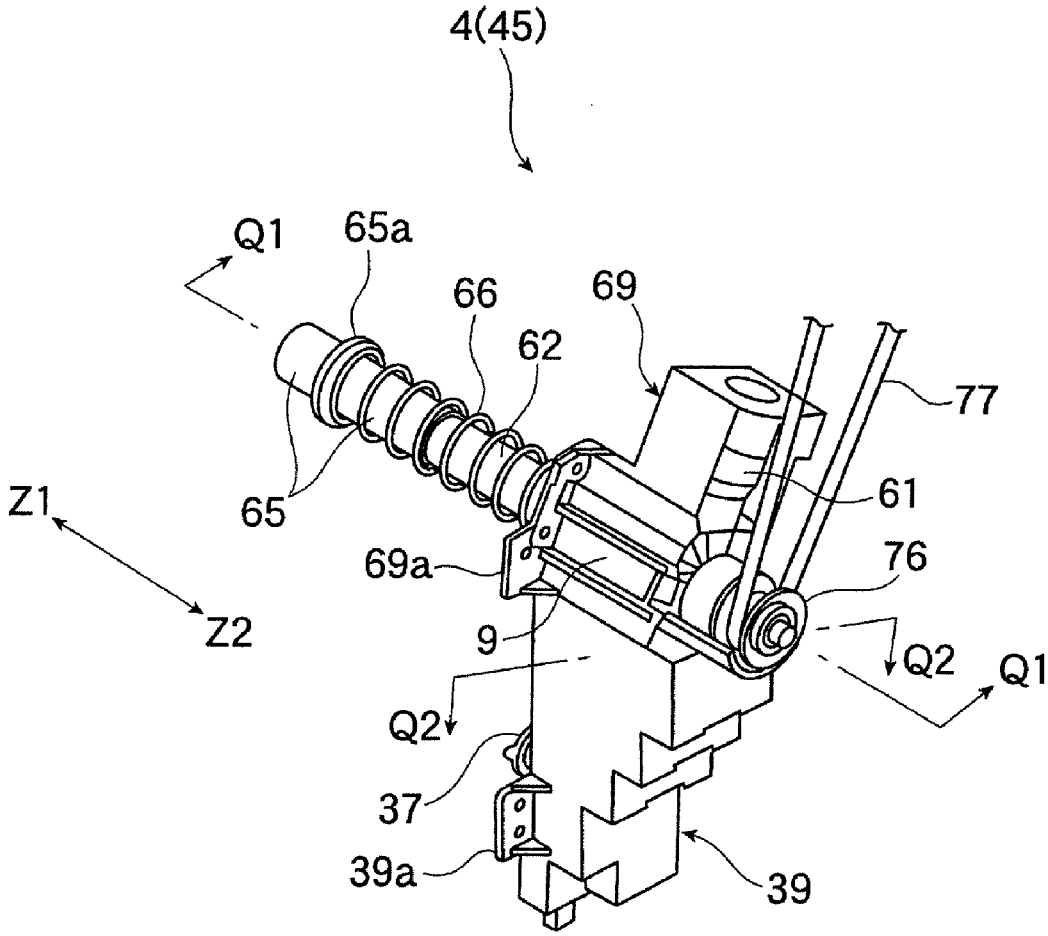
FIG. 8 is a cross-sectional view of a part (a fourth transporting part) of the transporting device of the recovering unit of FIG. 3.
Figure 9:
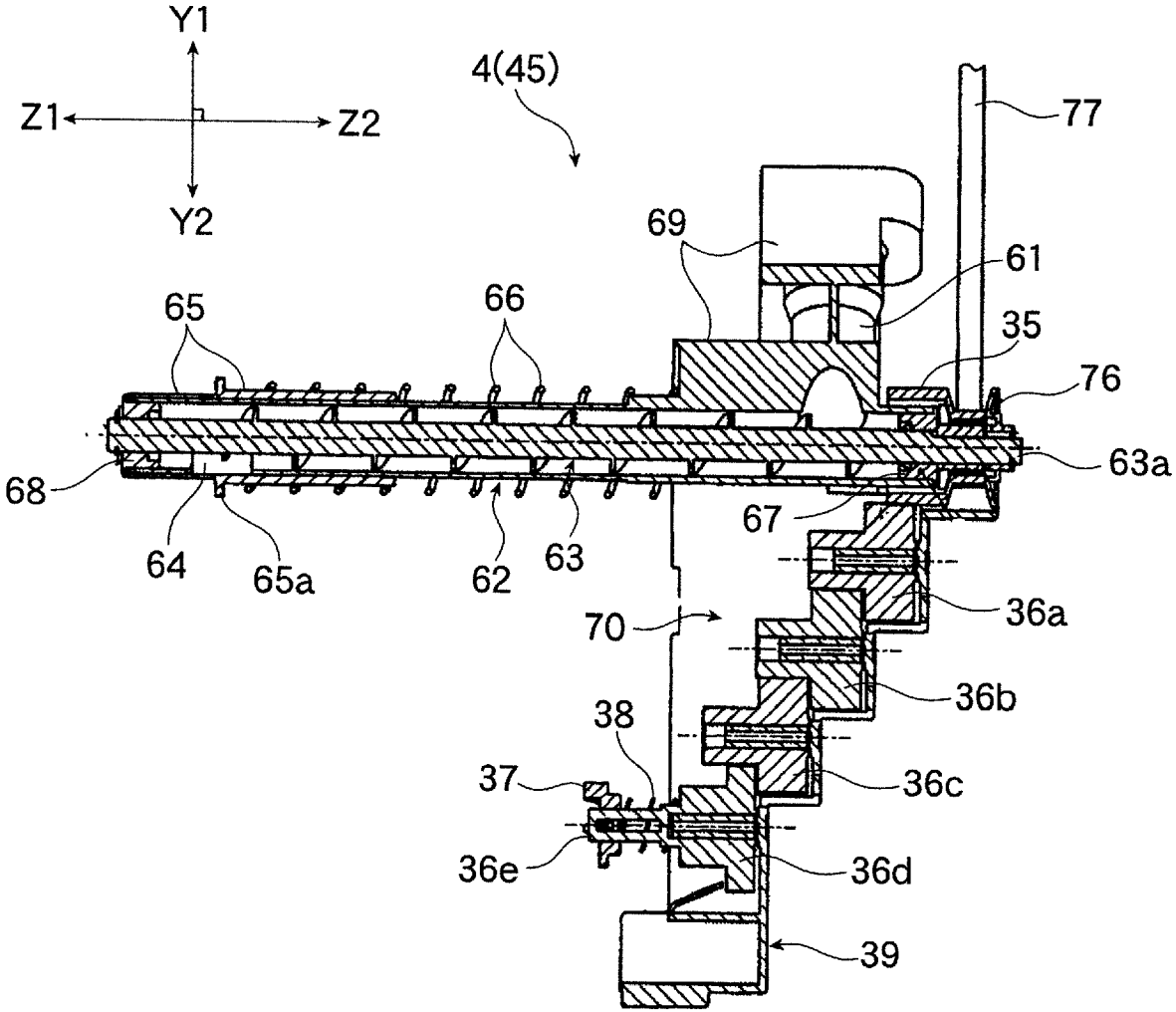
FIG. 9 is a cross-sectional view of a part of the transporting device taken on line Q1-Q1 of FIG. 8.

The fourth transporting part 45 includes, as illustrated in FIGS. 3, 8, 9 and the like, the connecting pipe 61 connected to the discharge opening 51*c* disposed at the lower end of the third conveyor pipe 51 of the third transporting part 44; a cylindrical fourth conveyor pipe 62 connected to the lower end of the connecting pipe 61 in substantially a perpendicular direction to the connecting pipe 61 and having a length in the substantially horizontal direction sufficient for being inserted into the inlet 21 of the recovery vessel 2; and an auger 63 for transporting the developer Ge (i.e., the mixture of the developers Ga, Gb and Gd) supplied from the third conveyor pipe 51 in the direction of the arrow Z1 by rotating in the conveyor space of the fourth conveyor pipe 52. The connecting pipe 61 is formed to be integrally connected to a connection supporting portion 69 of the fourth conveyor pipe 62. A reference numeral 69*a* used in FIG. 8 and the like denotes an attaching face used for fixing the fourth transporting part 45 on a supporting plate 106 of the casing 101.

As illustrated in FIGS. 3, 9 and the like, the fourth conveyor pipe 62 is connected to the lower opening of the connecting pipe 61 at one end thereof, and is formed to have such a length that the other end 62*b* thereof reaches a prescribed position of the conveyor pipe receiver/holder 25 of the recovery vessel 2 loaded (for example, a position at which the closing shutter 27 can be pushed to open the introducing port 26). Furthermore, the fourth conveyor pipe 62 has a discharge port 64 in a lower portion of the end 62*b* in a position opposing the introducing port 26 of the conveyor pipe receiver/holder 25 of the recovery vessel 2 loaded. Moreover, the fourth conveyor pipe 62 is provided with a closing shutter 65 for opening/closing the discharge port 64 at the end 62*b*.

The closing shutter 65 is formed as a cylindrical structure that is movably fit outside the end 62*b* of the fourth conveyor pipe 62, and is kept in a state that it is pushed in the direction of the arrow Z1 as a whole by an elastic member 66 of a coil spring or the like provided between a projection 65*a* formed at substantially the center along the lengthwise direction of its outer circumference and the connection supporting portion 69. When the fourth conveyor pipe 62 is not inserted into the conveyor pipe receiver/holder 25 of the recovery vessel 2, the closing shutter 65 is naturally pushed by the elastic member 66, so as to be moved to a position for blocking and closing the discharge port 64 of the fourth conveyor pipe 62 with a part thereof as illustrated in FIGS. 8 and 9. Alternatively, when the fourth conveyor pipe 62 is inserted into the conveyor pipe receiver/holder 25, the closing shutter 65 is moved against the pushing force of the elastic member 66 relatively to the fourth conveyor pipe 62 in the direction shown with the arrow Z2, so as to be displaced in a position not blocking but opening the discharge port 64.

Figure 11:
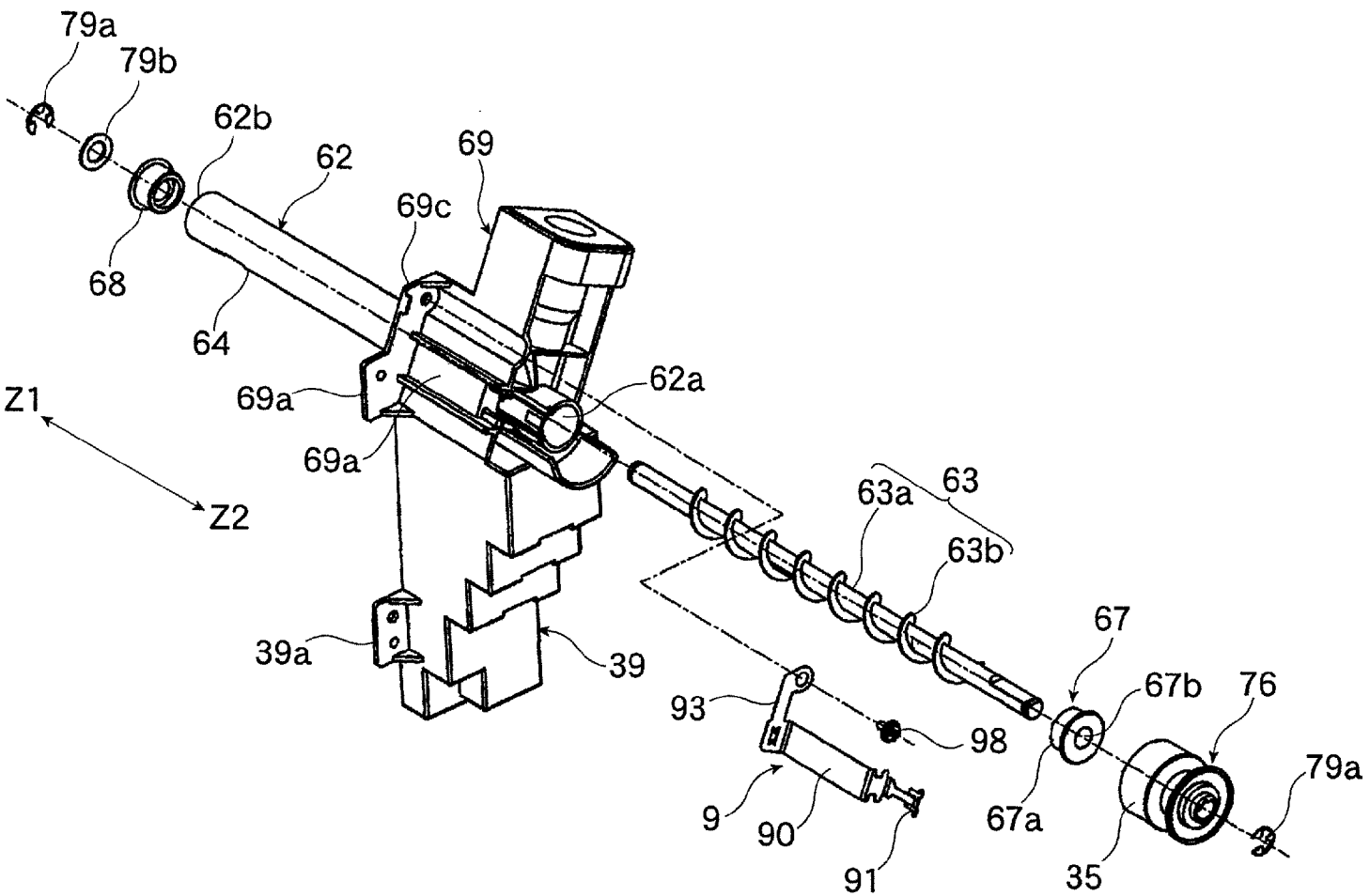
FIG. 11 is an exploded perspective view of a part of the transporting device of FIG. 8.

The auger 63 is formed by spirally and continuously winding a conveyor blade 63*b* around a rotating shaft 63*a*. As illustrated in FIGS. 9, 11 and the like, the auger 63 is inserted into the fourth conveyor pipe 62 opened at both the ends and its rotating shaft 63*a* is rotatably supported by ring-shaped bearings 67 and 68 (first bearing) fit and fixed in end openings 62*a* and 62*b* of the conveyor pipe 62.

The augers 47, 49 and 63 and (the crank shaft 54 of) the vertically moving loosening coils 52 and 53 working as transporting members of the transporting parts 41 through 45 of the transporting device 4 are driven with power supplied from a rotation drive transmission mechanism 7 described below. It is noted that the auger 47 corresponding to a transporting member of the first transporting part 403 is driven with power supplied from another rotation drive transmission mechanism 7 not shown.

The rotation drive transmission mechanism 7 includes, as illustrated in FIGS. 2, 3 and the like, a drive shaft 71 rotatably provided along the lengthwise direction of the second conveyor pipe 48 of the second transporting part 43 (i.e., the direction of the arrows X1 and X2) and rotated by receiving rotatory power of a motor (not shown). The rotatory power is transmitted to the augers 47 of the first transporting parts 41 and 42 from plural of worm gears 72 fixed to be spaced from one another on the drive shaft 71 through plural of transmission gears 73*a*, 73*b* and 73*c*. The rotatory power is transmitted to the auger 49 of the second transporting part 43 from a transmission gear 71*a* fixed on the drive shaft 71 and another transmission gear connected to the transmission gear 71*a*. The rotatory power is transmitted to the crank shaft 54 used for driving the vertically moving loosening coils 52 and 53 of the third transporting part 44 and the auger 63 of the fourth transporting part 45 through a belt driven transmission mechanism rotated by receiving the power of the drive shaft 71.

The belt driven transmission mechanism includes a drive pulley 74 connected to and rotated by the worm gear 72 fixed at an end of the drive shaft 71; a first idler pulley 75 attached on the rotation supporting shaft 55 of the crank shaft 54; a second idler pulley 76 attached on an end of the rotating shaft 63*a* of the auger 63; and a driving belt 77 hung over these pulleys 74 through 76. A reference numeral 78 used in FIG. 2 denotes a tension applying roll. Owing to this belt driven transmission mechanism, the rotatory power is transmitted to the crank shaft 54 from the first idler pulley 75 and to the auger 63 from the second idler pulley 76.

Furthermore, the rotation drive transmission mechanism 7 is provided additively with a transmission mechanism part 70 for transmitting the rotatory power to the inside transporting member 30 of the recovery vessel 2 as illustrated in FIGS. 3, 9 and the like.

The additively provided transmission mechanism part 70 includes a first transmission gear 35 provided integrally with and inside of the second idler pulley 76 of the belt driven transmission mechanism; plural of second transmission gears 36 rotated by receiving power supplied from the first transmission gear 35; and the contact type shaft coupler 37 attached on a shaft 36*e* of a transmission gear 36*d* disposed at the final stage of the plural second transmission gears. As the plural second transmission gears 36, for example, four double gears 36*a* through 36*d* are used. The shaft coupler 37 has a projection in contact with and engaged with the shaft coupler 32 of the inside transporting member 30 of the recovery vessel 2, is attached so as to be movable in the axial direction of the shaft 36*e* of the transmission gear 36*d* of the final stage (i.e., the direction of the arrows Z1 and Z2) and is kept in an elastically pushed state in the direction of the arrow Z1 by an elastic member 38 of a coil spring or the like provided in a space from the transmission gear 36*d*. A reference numeral 39 used in FIGS. 2, 3, 9 and the like denotes a supporting frame on which the plural second transmission gears 36 are provided, and this supporting frame 39 is attached, for example, to be connected to the connection supporting portion 69 of the fourth conveyor pipe 62 of the fourth transporting part 45. Also, a reference numeral 39*a* denotes an attaching face used for attaching and fixing the supporting frame 39 on the supporting plate 106 of the casing 101.

The developer is recovered by the developer recovering unit 1 in the following manner:

In this recovery device 1, the recovery vessel 2 is loaded in the vessel loading space formed in the casing 101 of the image forming apparatus 100 prior to the recovery of the developer. At this point, the recovery vessel 2 is pushed into the loading space in the direction of the arrow Z1 to be ultimately connected to the transporting device 4 and the like.

In loading the recovery vessel 2, the fourth conveyor pipe 62 of the fourth transporting part 45, that is, the most downstream portion of the transporting device 4, is inserted through the inlet 21 into the vessel to be ultimately held by the conveyor pipe receiver/holder 25, and thus, the recovery vessel 2 is connected to the transporting device 4. At this point, the discharge port 64 of the fourth conveyor pipe 62 is opened (see FIG. 3) because the closing shutter 65 is pushed by the exposed end portion 25*a* of the conveyor pipe receiver/holder 25 of the recovery vessel 2 pushed in the direction of the arrow Z2 (see FIG. 7) to be moved relatively to the fourth conveyor pipe 62. Also, the introducing port 26 of the conveyor pipe receiver/holder 25 is opened (see FIG. 3) because the closing shutter 27 is moved in the direction of the arrow Z1 by the end 62*b* of the fourth conveyor pipe 62 (or the auger 63) inserted into the conveyor pipe receiver/holder 25. Ultimately, the discharge port 64 of the fourth conveyor pipe 62 is inserted into and stops at the position opposing the introducing port 26 of the conveyor pipe receiver/holder 25. When the recovery vessel 2 is thus completely connected to the transporting device 4, the recovery vessel 2 is placed in a state where the developer having been transported by the transporting device 4 can be received and kept therein.

Furthermore, in loading the recovery vessel 2, the shaft coupler 32 of the inside transporting member 30 of the recovery vessel 2 is in contact with and engaged with the shaft coupler 37 of the transmission mechanism part 70 of the transporting device 4, so that the recovery vessel 2 can be connected to the transmission mechanism part (see FIG. 3). When the recovery vessel 2 is thus completely connected to the transmission mechanism part, the inside transporting member 30 is placed in a state where it can be rotatively driven within the vessel.

When an image forming operation or the like is performed, drive units such as the rotation drive transmission mechanism 7 and the transmission mechanism part 70 are operated in the recovering unit 1, so that the transporting members of the transporting parts 41 through 45 and 403 of the transporting device 4, that is, the augers 47, 49 and 63 and the vertically moving loosening coils 52 and 53, are provided with power so as to be driven for rotation or the like within the conveyor pipes 46, 48, 51 and 62. On the other hand, the developer Ga (Y, M, C and K) obtained by the aforementioned trickle method and the developer Gb (Y, M, C and K) and the developer Gd obtained through the cleaning operations are discharged from the developing device 114, the first cleaning device 116 and the second cleaning device 128 of each imaging unit 101 (Y, M, C or K) of the image forming apparatus 100.

First, the developer Ga discharged from the developing device 114 is transported in the direction of the arrow Z2 through the conveyor pipe 46 of the first transporting part 41 by the auger 47 rotating therein and sent to the second transporting part 43. Also, the developer Gb discharged from the first cleaning device 116 is transported in the direction of the arrow Z2 through the conveyor pipe 46 of the first transporting part 41 by the auger 47 rotating therein and sent to the second transporting part 43. Furthermore, the developer Gd discharged from the second cleaning device 128 is transported in the direction of the arrow Z2 through the conveyor pipe 46 of the first transporting part 403 by the auger 47 rotating therein and sent to the third transporting part 44.

Subsequently, the developers Ga and Gb having been transported through the first transporting parts 41, 42 and 403 are collected by being successively sent to the conveyor pipe 48 of the second transporting part 43, transported in the direction of the arrow X2 through the conveyor pipe 48 by the auger 49 rotating therein and sent to the third transporting part 44. The developer Gd having been transported through the first transporting part 403 is directly sent to the third transporting part 44. Thereafter, the developers Ga and Gb having been transported through the second transporting part 43 and the developer Gd having been transported through the first transporting part 403 are sent to the conveyor pipe 51 of the third transporting part 44, dropped downward through the conveyor pipe 51 and sent to the fourth transporting part 45. In the third transporting part 44, the developers Ga, Gb and Gd come into contact with the vertically moving loosening coils 52 and 53 vertically driven within the conveyor pipe 51, and hence, even when the developers are aggregated, the aggregation is loosened, and the developers are prevented from adhering onto the inner wall of the conveyor pipe 51 or depositing thereon as a result of the adhesion.

After the developer Ge (i.e., the mixture of the developers Ga, Gb and Gd) having been transported to the fourth transporting part 45 is sent to the fourth conveyor pipe 62 from the third conveyor pipe 51, it is transported in the direction of the arrow Z1 through the fourth conveyor pipe 62 by the auger 63 rotating therein and ultimately discharged from the discharge port 64 of the conveyor pipe 62 to be dropped into the recovery vessel 2 through the introducing port 26 of the conveyor pipe receiver/holder 25.

In this manner, the developers Ga and Gb discharged from the developing device 114 and the first cleaning device 116 are transported from the first transporting parts 41 and 42, that is, a most upstream transport path section of the transporting device 4, through the second transporting part 43 and the third transporting part 44, that is, an intermediate transport path section, to the fourth transporting part 45, that is, a most downstream transport path section, so as to be dropped into the recovery vessel 2 for recovery.

Figure 15:
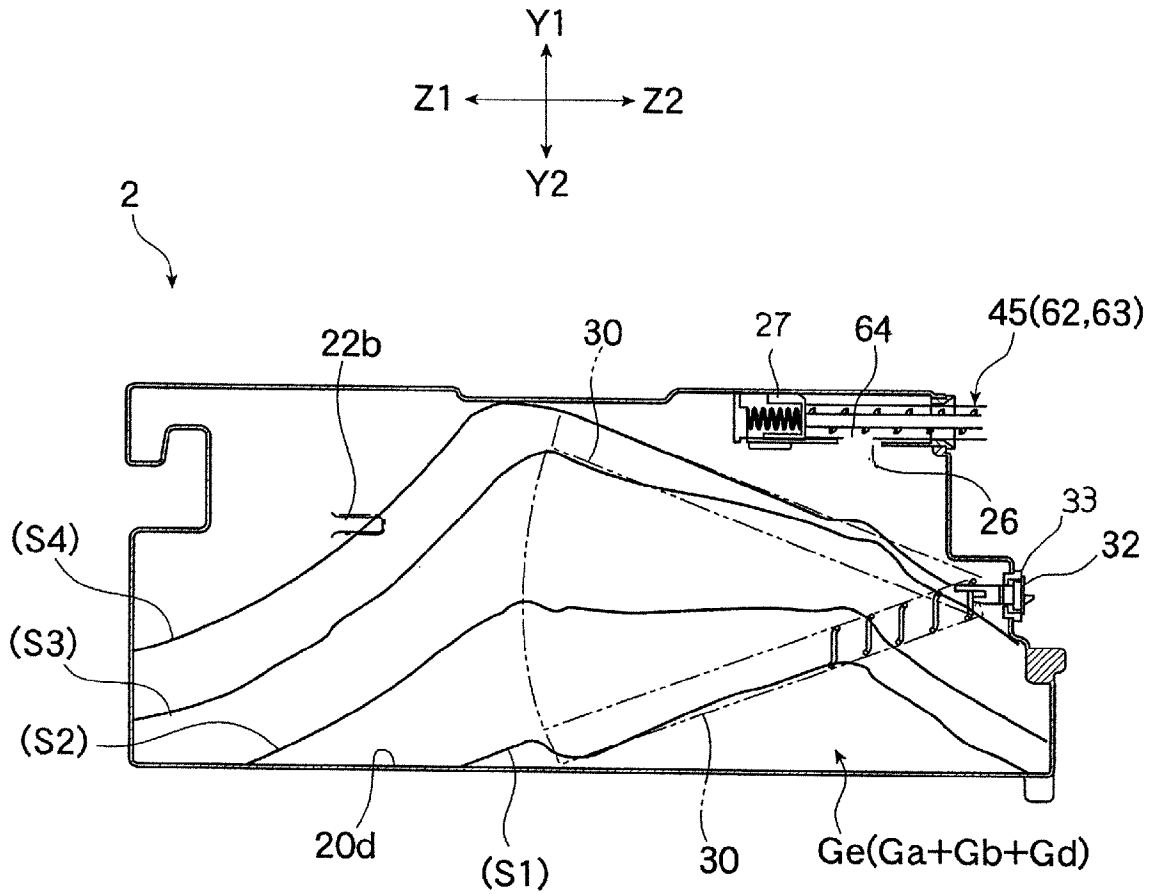
FIG. 15 is an explanatory diagram illustrating various deposition states of a developer contained in the recovery vessel.

The developer Gc to be kept in the recovery vessel 2 starts to deposit from a portion of the bottom 20*d* of the vessel disposed right below the introducing port 26 of the conveyor pipe receiver/holder 25. When the developer Gc, which has started to deposit within the recovery vessel 2 directly on its bottom 20*d* as an initial state, deposits to attain a state where the deposited developer comes into contact with the inside transporting member 30 rotatively driven, the developer is transported toward the side of the free end 30*b* by the transporting force applied by the inside transporting member 30 rotatively driven and is partly moved inward (in the direction of the arrow Z1) on the bottom 20*d*. A solid line S1 shown in FIG. 15 represents a deposited state (shape) of the developer Gc obtained immediately after the transporting force of the inside transporting member 30 starts to function.

In the recovering unit 1, when the developer Gc kept therein is deposited to the level of the projection portion 22*b* of the detecting/measuring part 22 of the recovery vessel 2, the optical type detector 80 corresponding to the detecting device 8 detects that the quantity of light received by the light receiving part 82 is reduced because the transmission of the detection light H emitted from the light emitting part 81 is blocked by the deposited developer Gc. The detection information obtained by the detector 80 at this point is sent to the controller 105. When it is determined on the basis of the sent detection information that the amount of the developer Gc kept therein has reached the set amount, the controller 105 displays, for example, a message for requesting exchange of the recovery vessel 2 on a displaying portion not shown of the image forming apparatus 100 or a display portion of a device connected to the image forming apparatus 100.

In the developer recovery device 1, what is called error detection may occur. In this error detection, even when the developer Gc contained in the recovery vessel 2 is not actually deposited up to the level of the projection portion 22*b* of the detecting/measuring part 22 as exemplified with a solid line S2 or S3 in FIG. 15, the detector 80 detects that the amount of the contained developer Gc has reached the set amount in error.

According to the study of the present inventors, when the state of the recovery vessel 2 is observed in occurrence of such error detection, it has been found that a part of the contained developer Gc is adhered onto an inner wall portion corresponding to the projection portion 22*b* of the detecting/measuring part 22 and the light is minimally transmitted due to the developer adhered onto the inner wall portion. Such a part of the developer Gc is seemed to be attracted and adhered onto the inner wall of the recovery vessel 2 through an electric function (an electrostatic function) when dispersedly floating within the vessel after dropping into the recovery vessel 2.

In the case where this error occurs, the conveyor pipes 46, 48, 51, 61 and 62 of the transporting parts 41, 42 and 403 and the connection supporting portion 69 of the recovering unit 1 are made of a high-resistance or electrically insulating material such as an ABS resin (an acrylonitrile butadiene styrene copolymer) and the augers 47 and 63 are made of a high-resistance or electrically insulating material such as an ABS resin or a PC (polycarbonate)-ABS resin. (It is noted that the auger 47 of this exemplary embodiment is made of a similar material.) Furthermore, the vertically moving loosening coils 52 and 53 are made of a low-resistance or electrically conducting material such as stainless steel and are not grounded.

Moreover, in the case where the error occurs, the recovery vessel 2 has the electrically insulating property as described above. Furthermore, since the developer Gc to be recovered includes a carrier, the developer is charged from the first and may be charged again in passing through a transfer electric field formed in the transfer process or charged again through triboelectric charging during the process for transporting it to keep it in the vessel for the recovery.

Therefore, in this developer recovering unit 1, as a countermeasure for overcoming this problem, the auger 63 of the fourth transporting part 45, that is, the most downstream portion of the transporting device 4, is provided with a conductive property by using a metal such as stainless steel for forming it, and the auger 63 is grounded. In addition, the inside transporting member 30 of the recovery vessel 2 is also provided with a conductive property by using a metal for forming it, and the inside transporting member 30 is also grounded.

Figure 10:
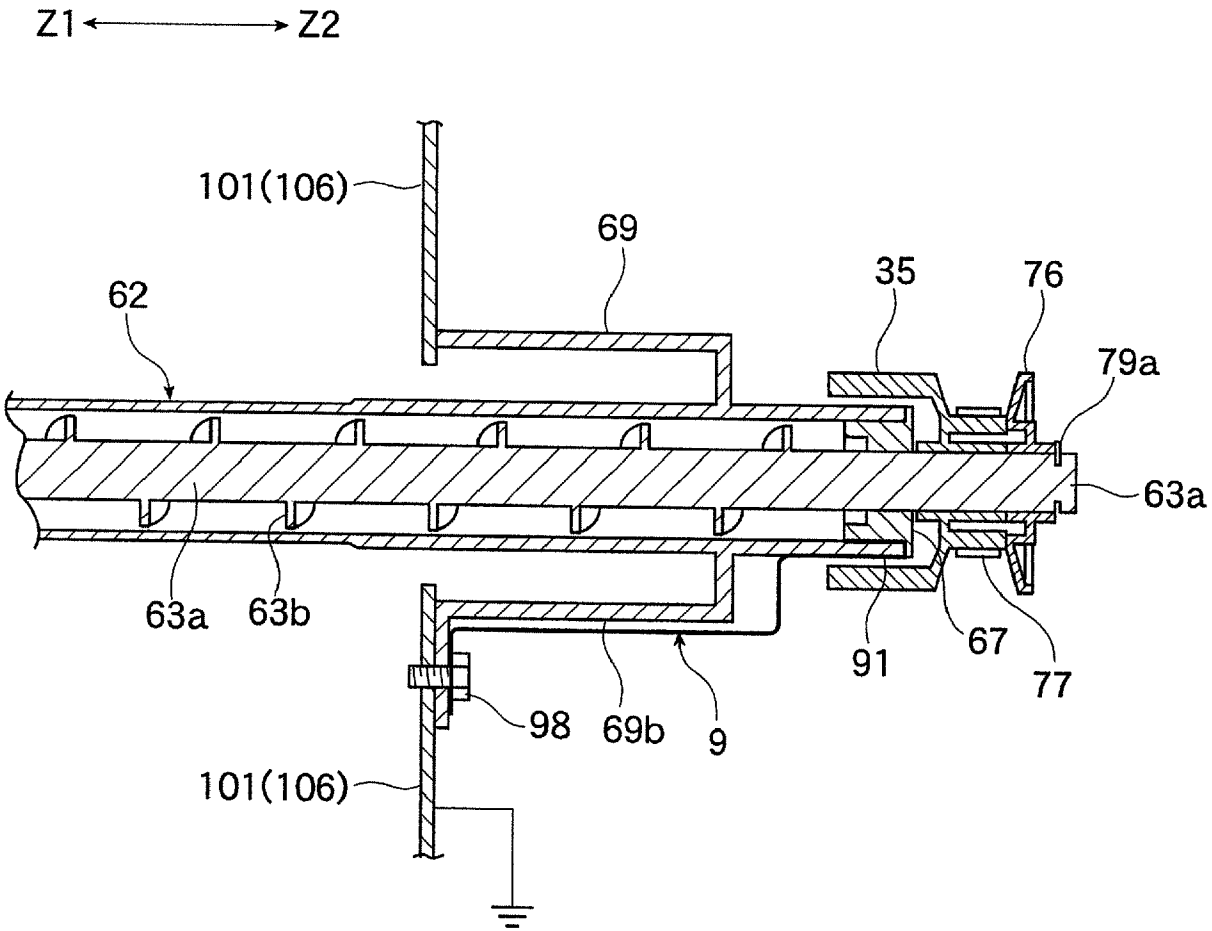
FIG. 10 is a cross-sectional view a part of the transporting device taken on line Q2-Q2 of FIG. 8.

As illustrated in FIGS. 10, 11 and the like, the auger 63 of the fourth transporting part 45 is grounded by using a grounding metal plate 9, and specifically, a part of the metal plate 9 is electrically connected to the auger 63 through one bearing 67 of the auger 63 and another part of the metal plate 9 is attached to the supporting plate 106, made of a metal and grounded, of the casing 101 of the image forming apparatus. In this case, the bearing 67 is made of a metal material and has a conductive property.

Figure 12:
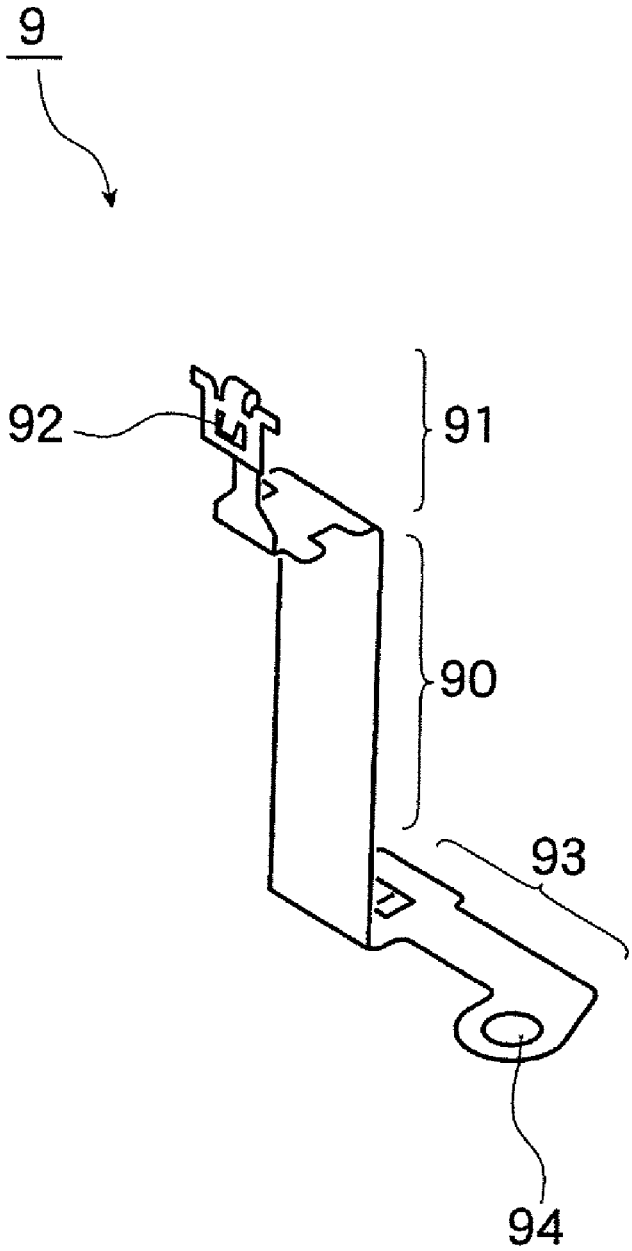
FIG. 12 is a perspective view of a grounding metal plate used in a part of the transporting device of FIG. 8.

The grounding metal plate 9 is obtained by, for example, bending a substrate cut into substantially an L shape in a shape according to the portion for attaching it as illustrated in FIG. 12. The metal plate 9 used in this exemplary embodiment has, at substantially the center thereof, a trunk 90 to be attached onto a positioning portion 69*b* partitioned with substantially parallel ribs on the connection supporting portion 69 of the fourth transporting part 45. Also, the metal plate 9 is made of stainless steel.

Figure 13:
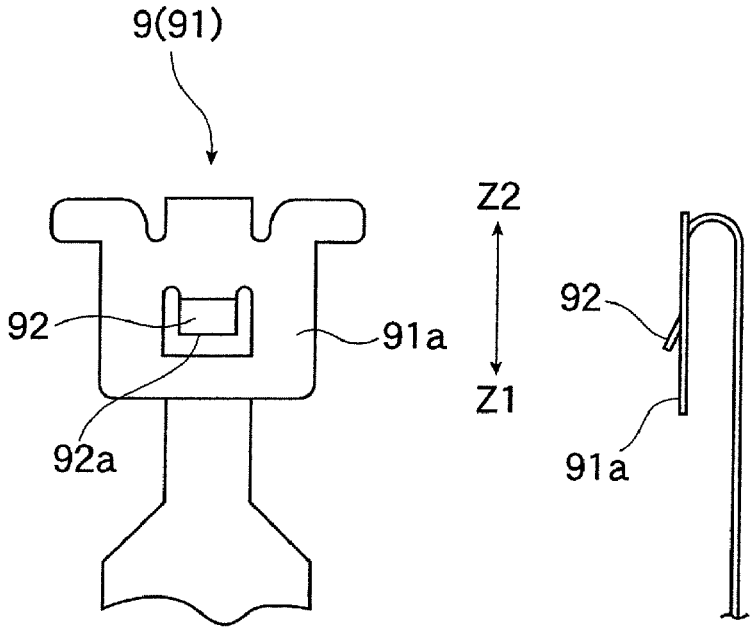
FIG. 13 is enlarged front view and side view of a part (a contact portion) of the metal plate of FIG. 12.

Also, the metal plate 9 has an insertion portion 91 formed by bending one end of the trunk 90 into a shape to be inserted into and caught by the edge of the end opening 62*a* of the conveyor pipe 62. In a part of a tip contact face 91*a* of the insertion portion 91 to be in contact with an outer circumferential face 67*a* of the bearing 67, a notch 92 is formed so as to have a free end 92*a* free in an insertion direction (i.e., the direction of the arrow Z1) and the notch 92 is bent and kept to protrude outside (i.e., a side toward the outer circumferential face of the bearing 67) as illustrated in FIG. 13.

Furthermore, the metal plate 9 has an attachment portion 93 formed by bending the other end of the trunk 90 into a shape to be attached in contact with the attaching face 69*a* of the connection supporting portion 69 of the fourth transporting part 45. At an end of the attachment portion 93, a tapped hole 94 for a fixing screw 98 used for attaching and fixing the metal plate 9 is formed. The tapped hole 94 is formed in a position according to the position of a tapped hole 69*c* (see FIG. 11) formed on the attaching face 69*a* of the connection supporting portion 69.

In attaching the metal plate 9, with the trunk 90 of the metal plate 9 kept first in a position opposing the positioning portion 69*b* of the connection supporting portion 69 of the fourth transporting part 45 as if it are attached thereon, the insertion portion 91 is moved in the direction of the arrow Z1 to be inserted into and caught by the edge of the end opening 62*a* of the fourth conveyor pipe 62. Subsequently, the attachment portion 93 is brought into contact with the attaching face 69*a* of the connection supporting portion 69 of the fourth transporting part 45, and then, the metal plate 9 is fixed with the fixing screw 98 of a metal put through the tapped hole 94 onto (a tapped hole of) the supporting plate 106 of the casing 101. In this manner, the attachment of the metal plate 9 is completed.

In placing the auger 63 in a grounded state, as illustrated in FIG. 11 or the like, the auger 63 is inserted into the fourth conveyor pipe 62 to which the metal plate 9 has been attached, and the bearings 67 and 68 are fit and fixed in the end openings 62*a* and 62*b* of the conveyor pipe 62 with the rotating shaft 63*a* of the auger 63 put through a bearing hole 67*b*. Thus, the outer circumferential face 67*a* of the bearing 67 fit in the end opening 62*a* of the fourth conveyor pipe 62 is in contact with the tip contact face 91*a* of the insertion portion 91 of the metal plate 9.

As a result, as illustrate in FIG. 10, the rotating shaft 63*a* of the auger 63 is electrically connected to the metal plate 9 through the bearing 67 as well as electrically connected to the supporting plate 106 of the casing 101 grounded through the metal plate 9 (including the fixing screw 98), and hence, the auger 63 is kept in a grounded state. A reference numeral 79*a* used in FIG. 11 or the like denotes an E type anchor fit in a groove formed at an end of the rotating shaft 63*a* of the auger, and a reference numeral 79*b* denotes a washer.

Figure 14:
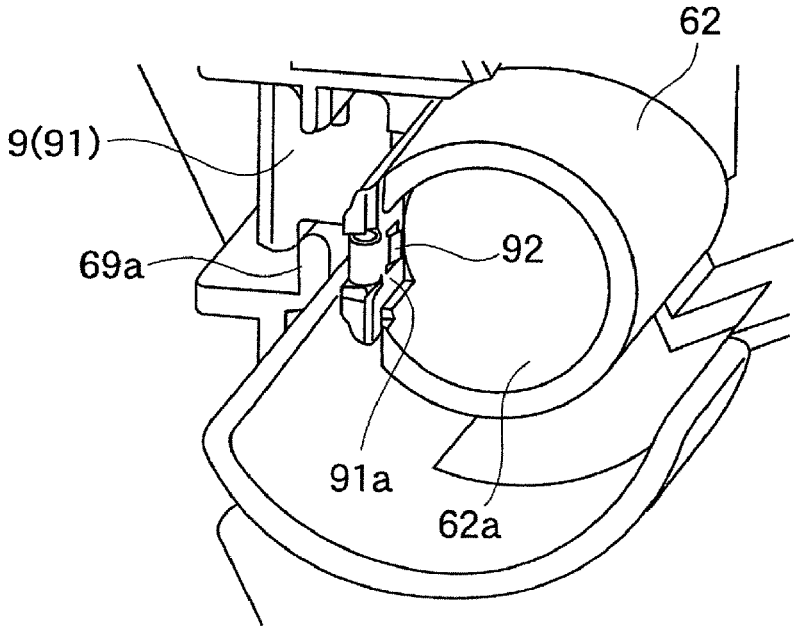
FIG. 14 is a partial perspective view illustrating a state where the metal plate of FIG. 12 is attached.

In grounding the auger 63, the notch 92 of the insertion portion 91 of the metal plate 9 is closer to the bearing 67 than the tip contact portion 91*a* of the insertion portion 91 as illustrated in FIG. 14, so as to be definitely in contact with the outer circumferential face 67*a* of the bearing.

Furthermore, since the notch 92 has the free end 92*a* formed in the insertion direction of the insertion portion 91 to be bent to protrude toward the bearing 67 (see FIG. 14), when the bearing 67 is fit in the end opening 62*a* of the fourth conveyor pipe 62, the free end 92*a* is pushed to fall by the bearing 67, and hence is not an obstacle to the fitting of the bearing 67. On the other hand, since the free end 92*a* of the notch 92 bites the outer circumferential face 67*a* of the bearing 67 after the bearing 67 is fit in the end opening 62*a* of the fourth conveyor pipe 62, it causes resistance against the movement of the bearing 67 in a direction to come off from the end opening 62*a* (i.e., the direction of the arrow Z2), and thus, the notch 92 works to prevent the bearing 67 from coming off from the end opening 62*a*.

For grounding the inside transporting member 30 of the recovery vessel 2, the supporting shaft 31 and the shaft coupler 32 of the inside transporting member 30 are made of a metal material or a conductive material, the bearing 33 of the supporting shaft 31 is made of a metal material or a conductive material, and the bearing 33 of the supporting shaft 31 (see FIG. 7) is grounded. The bearing 33 is grounded by attaching, for example, a grounding metal plate 95 described later on the grounded supporting plate 106 of the casing 101 and keeping a part of the grounding metal plate in contact with a portion of the bearing 33 exposed outside the vessel.

Owing to the aforementioned structure, when the recovery vessel 2 is loaded, the inside transporting member 30 is grounded because the bearing 33 of the supporting shaft 31 is in contact with a part of the grounding metal plate attached on the grounded supporting plate 106. As a result, since the inside transporting member 30 is electrically connected to the grounded bearing 33 through the supporting shaft 31, it is kept in a grounded state.

The developer is recovered by the developer recovering unit 1 in which the aforementioned countermeasure (namely, the structure for grounding) is employed, and the state of the developer Gc kept in the recovery vessel 2 is observed at timing when the detector 80 detected that the amount of the contained developer Gc had reached the set amount. As a result, as illustrated with a solid line S4 in FIG. 15, it is found that the developer Gc is deposited up to the level of the projection portion 22*b* of the detecting/measuring part 22 of the recovery vessel 2. In other words, it is found that the detector 80 had performed accurate detection.

Furthermore, the present inventors variously observed the inside state of the recovery vessel 2 before the detector 80 detected the set amount in recovering the developer by using this recovering unit 1. As a result, it is found that the developer Gc (the toner to be more precise) is not adhered at all or is adhered in an amount remarkably smaller than that adhered, with the aforementioned countermeasure not employed, on the inner wall (on the detecting/measuring part 22 in particular) of a region where the developer Gc is not actually deposited. In addition, even when the recovery vessel 2 keeping the developer therein is directly touched with a hand after the detection by the detector 80, electrostatic discharge is never caused from the vessel 2 to the hand.

Moreover, since the auger 63 of the fourth transporting part 45 corresponding to the most downstream portion of the transporting device 4 of this recovering unit 1 is made of a conductive member (specifically, a metal material in this exemplary embodiment), the cost is higher than in using an auger made of a nonconductive synthetic resin. Since the transporting device 4 including the auger 63 and the like is installed and remains in the casing 101 of the image forming apparatus 101, however, as compared with the case where the auger 63 made of such a conductive member is provided in the recovery vessel 2, that is, a replacement, the cost increase is suppressed because the number of augers to be fabricated is smaller (than the number of recovery vessels 2 to be fabricated as replacements). Furthermore, since the grounded auger 63 is disposed in the internal space of the vessel 2 when the recovery vessel 2 is loaded in the image forming apparatus 100, the internal space attains higher antistatic performance.

Figure 16:
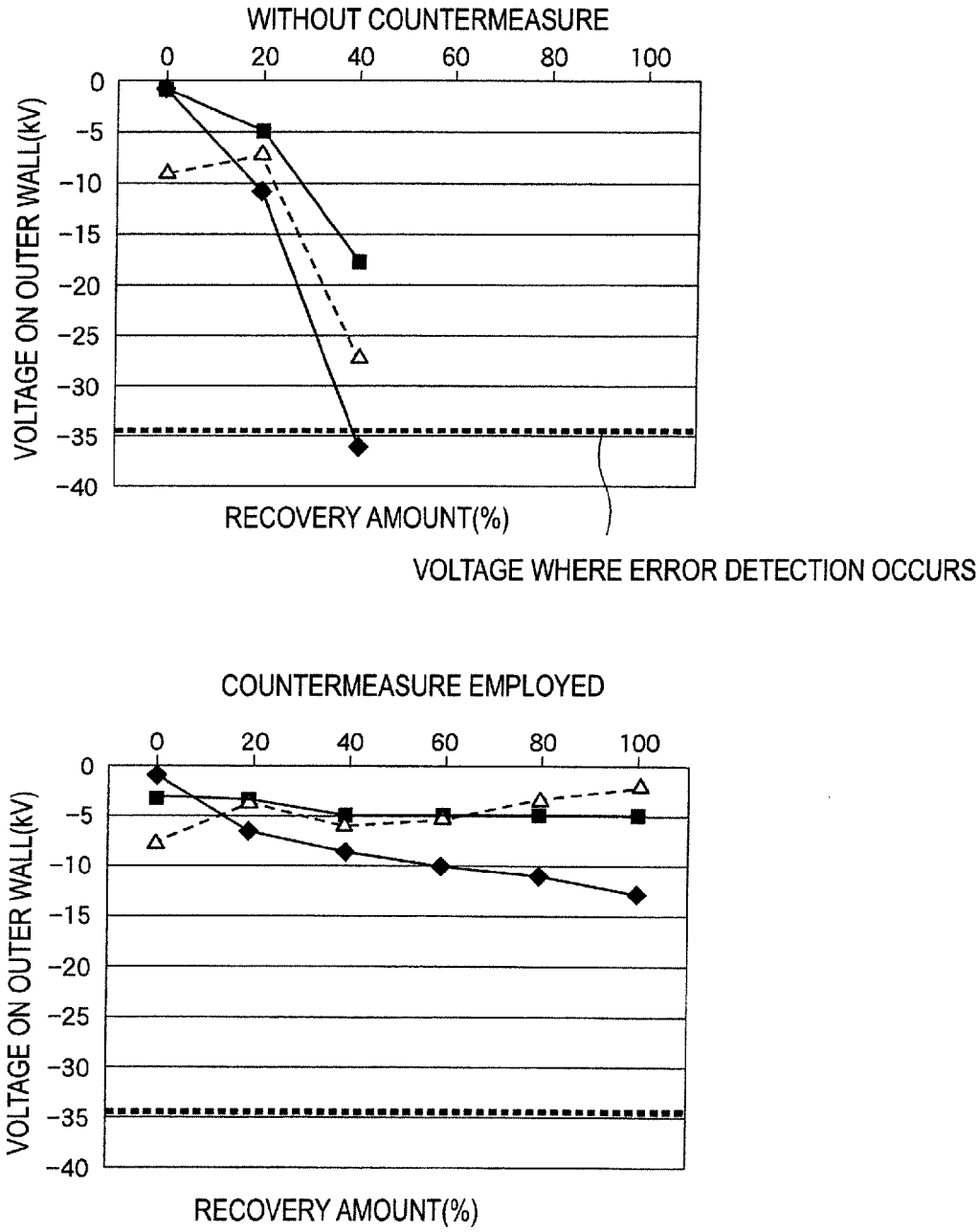
FIG. 16 illustrates graphs of test results.

FIG. 16 illustrates voltages on an outer wall of the recovery vessel 2 measured at every amount of developer Gc kept therein (represented by a percentage to the set amount) in recovery tests for the developer performed by using the developer recovering units 1 obtained with and without employing the countermeasure.

The recovery test for the developer is performed as follows: An unused recovery vessel 2 is loaded; a predetermined amount (specifically, 15 g/min.) of a developer composed of a charged nonmagnetic toner and a magnetic carrier (made of ferrite particles) (with a toner ratio of 50 through 70 wt %) is supplied from the inlet 46*a* of the first transporting part 41; and a voltage on the outer wall of the recovery vessel 2 is measured when the amount of the developer reached every amount (%). The nonmagnetic toner is an emulsion polymeric toner of a polyester resin (with an average particle diameter of 5.8 μm; including an external additive for providing functions of electrostatic property control and easy cleanability). Positions on the outer wall of the vessel where the voltage is measured are the following three positions as illustrated in FIG. 6: (1) the projection portion (sensor portion) of the detecting/measuring part 22; (2) the recess portion (grip portion) of the grip 23; and (3) a bottom portion (a staying portion) within the vessel where the developer Gc dropped from the introducing port 26 to be kept therein mainly stays. The voltage is measured in an atmosphere of a temperature of 23° C. and a moisture of 10% RH by using a high-voltage probe (manufactured by Kasuga Electric Works Ltd.; type name: KDS-0103) as a measuring device.

Furthermore, a recovering unit obtained without grounding the inside transporting member 30 (more specifically, the bearing 33 of the supporting shaft 31) in the recovering unit 1 of this exemplary embodiment is used as the recovering unit obtained with the countermeasure employed. On the other hand, a recovering unit obtained without employing the countermeasure is different from the recovering unit 1 obtained with the countermeasure employed in a point that not only the inside transporting member 30 of the recovering unit 1 of this exemplary embodiment is not grounded but also the auger 63 of the fourth transporting part 45 is not grounded (more specifically, the grounding metal plate 9 is not provided).

It is presumed, on the basis of the results illustrated in FIG. 16, that a voltage within the recovery vessel 2 is not increased or minimally increased even when the amount of the contained developer is increased in the developer recovery performed by using the recovering unit 1 obtained with the countermeasure employed. Similar tests are performed under several kinds of conditions ranging from the aforementioned environment of the temperature and the moisture to an environment of a temperature of 25° C. and a moisture of 50% RH, and results had similar tendency to that of the aforementioned results (illustrated in a lower graph of FIG. 16).

In addition, similar tests are performed under similar conditions by using, as the recovering unit 1 obtained with the countermeasure employed, a recovering unit in which not only the auger 63 is grounded but also the inside transporting member 30 is grounded as in this exemplary embodiment. As a result, a voltage on the outer wall is further lower than in the results illustrated in the lower graph of FIG. 16. Furthermore, similar tests are performed under similar conditions by using, as the recovering unit 1 obtained with the countermeasure employed, a recovering unit in which the auger 63 is not grounded (more specifically, the auger 63 is made of a non-conductive material and placed in a ungrounded state) but the inside transporting member 30 is grounded as in this exemplary embodiment, and thus, good results similar to those illustrated in the lower graph of FIG. 16 are obtained.

Alternative Exemplary Embodiments

Although the auger 63 of the fourth transporting part 45 is grounded through the bearing 67 by using the metal plate 9 in Exemplary embodiment 1, it may be grounded by employing another structure.

Figure 17:
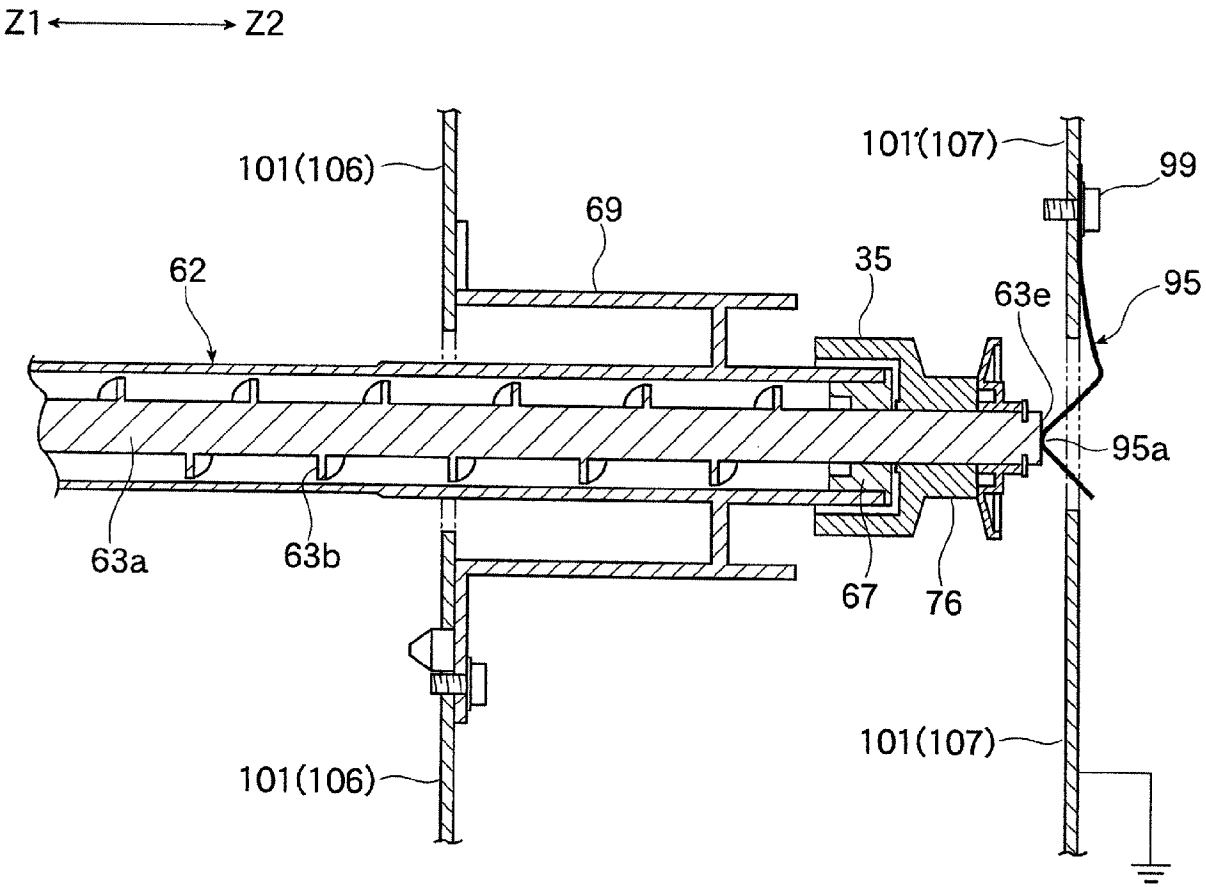
FIG. 17 is a cross-sectional view of a main part of another structure for grounding an auger.

For example, a grounding metal plate 95 attached on the grounded supporting plate 107 of the casing 101 may be in contact with (an end side face 63*e* of) the rotating shaft 63*a* of the auger 63 as illustrated in FIG. 17. The metal plate 95 has, for example, a contact projection 95*a* formed by bending one end thereof into a shape to be in contact (in a point or in a plane) with the end side face 63*e* of the rotating shaft 63*a* and further has a tapped hole at the other end thereof. The metal plate 95 is attached with the contact projection 95*a* in contact with the end side face 63*e* of the rotating shaft of the auger 63 and with the other end fixed on the supporting plate 107 with a fixing screw 99 of a metal. At this point, the metal plate 95 is attached in a state where it is elastically deformed to warp in a direction away from the end side face 63*e* of the rotating shaft (namely, in the direction of the arrow Z2) as exemplified in FIG. 17, so that the contact projection 95*a* can elastically come into contact with the end side face 63*e* of the rotating shaft. In this case, the rotating shaft 63*a* of the auger 63 is electrically connected to the grounded supporting plate 107 of the casing 101 through the metal plate 95 (including the fixing screw 99), and thus, it is kept in a grounded state.

In this structure, since the metal plate 95 is provided to be directly in contact with the rotating shaft 63 that rotates, rubbing sound (noise) is caused in their contact portions. On the other hand, when the metal plate 9 is provided through the bearing 67 as described in Exemplary embodiment 1, such contact portions are not formed and hence noise derived from the contact portions can be avoided.

Although both the auger 63 of the fourth transporting part 45 and the inside transporting member 30 of the recovery vessel 2 are grounded in Exemplary embodiment 1, merely one of them may be grounded. Also when merely one of them is grounded, it has been found that the detection can be normally performed with the aforementioned error detection avoided.

Alternatively, the inside transporting member 30 may be grounded by, for example, grounding the shaft coupler 37 and the transmission gears 36 of the rotation drive transmission mechanism connected to the shaft coupler 32. In this case, the shaft coupler 37 and the transmission gears 36 of the rotation drive transmission mechanism are grounded as follows: The shaft coupler and the gears are made of a conductive material, the rotating shaft 63*a* of the auger 63 is grounded as described above, and the second idler pulley 76 and the transmission gear 35 having a conductive property are integrally provided on the rotating shaft 63*a*. Thus, the shaft coupler and the gears are grounded through the grounded auger 63. As a result, when the recovery vessel 2 is loaded and the shaft coupler 32 of the inside transporting member 30 is brought into contact with and engaged with the shaft coupler 37 of the rotation drive transmission mechanism, the inside transporting member 30 is electrically connected to the grounded shaft coupler 37 and the grounded transmission gears 36 of the rotation drive transmission mechanism (also to the grounded auger 63 to be more precise), and thus, the inside transporting member 30 is kept in a grounded state.

Although the auger 63 of the fourth transporting part 45, that is, the most downstream transport path section of the transporting device 4, is grounded in the structure described in Exemplary embodiment 1, part of or all of the augers 47 of the first transporting parts 41 and 42, the auger 49 of the second transporting part 43 and the vertically moving loosening coils 52 and 53 of the third transporting part 44 may be additionally grounded with a conductive material also used for forming them. When any of the transport path sections disposed upstream the fourth transporting part 45 (namely, any of the first through third transporting parts 41 through 44 or the like) is grounded in the transporting device 4 instead of the most downstream transport path section (i.e., the fourth transporting part 45), it has been found that the developer may be adhered onto the inner wall of the recovery vessel 2 so as to cause the error detection. Also, when the transporting device 4 includes a single transporting part (composed of one conveyor pipe and one transporting member) instead of the plural transporting parts 41 through 45, the one transporting member of the single transporting part is formed by using a conductive member and is grounded. In the case where a transporting member such as an auger, the bearing 67 or the like to be grounded is formed by using a conductive member, it may be made of a metal material or it may be made of a synthetic resin or the like having a conductive property. The whole of a member to be grounded is not always formed as a conductive member but at least the surface thereof may be formed as a member having a conductive property.

Figure 18:
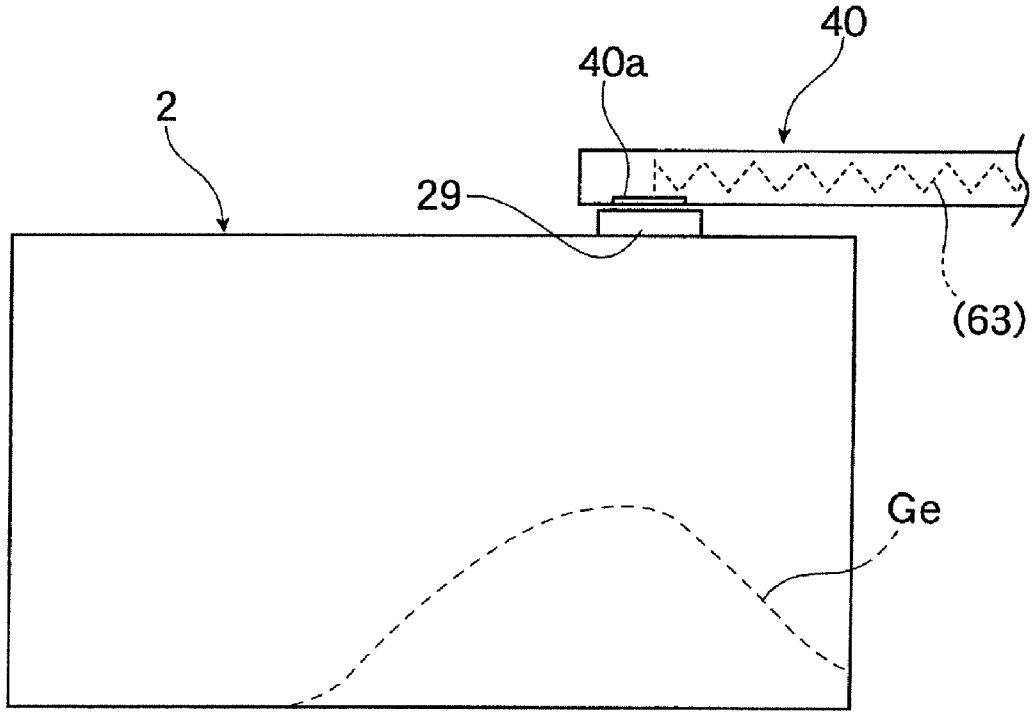
FIG. 18 is an explanatory diagram of a main part of another structure for connecting the transporting device and the recovery vessel.

A part of the fourth transporting part 45 corresponding to the most downstream transport path section of the transporting device 4 is inserted into the vessel (through the conveyor pipe receiver/holder 25) in the structure described in Exemplary embodiment 1, which does not limit the invention. Instead, for example, a most downstream transporting part 40 of the transporting device may be connected outside the recovery vessel 2 as illustrated in FIG. 18. A reference numeral 40*a* used in FIG. 18 denotes a discharge port for the developer of a conveyor pipe of the transporting part 40, and a reference numeral 29 denotes an introducing port for the developer of the recovery vessel 2. Also when the transporting device 4 and the recovery vessel 2 employing such an external connecting structure are used, it is effective to ground the auger 63 or the like in at least the most downstream conveyor pipe.

Alternatively, a vessel not provided with the inside transporting member 30 may be used as the recovery vessel 2. As the transporting member used in the transporting device 4, another transporting member capable of transporting the developer by rotating within a transport path (pipe) may be used instead of the augers 47, 49 and 63. When such another transporting member is used, at least one provided in the most downstream transport path section of the transporting device 4 (such as the fourth transporting part 45) is formed as a member having a conductive property. Also, the grounding of the transporting member to be grounded in the transporting device 4 is not limited to that exemplified in Exemplary embodiment 1 attained by using the grounded supporting member of the casing 101 of the image forming apparatus 100 but the transporting member may be directly grounded. Furthermore, as the developer to be recovered into the recovery vessel 2, a developer other than the aforementioned developer composed of the toner and the carrier may be used. An example of such a developer is a developer including a non-magnetic toner (what is called a single component developer) and used in a charged state.

Moreover, the detecting device 8 is not limited to the optical type detector 80 but may be a detecting device of another type. For example, a permeability sensor or the like for detecting the amount of the contained developer by using the magnetic property of the carrier of the developer or the like may be used although it is disadvantageous in cost to the optical type detector 80. Furthermore, the recovering unit 1 may recover, into the recovery vessel 2, a developer obtained by the second cleaning device 28 cleaning the surface of the intermediate transferring belt 21.

The image forming apparatus 100 may include, as the imaging device 102, plural of imaging units other than the four imaging units 110. Alternatively, in the image forming apparatus 100, the imaging device 102 may not employ the intermediate transferring unit 120 exemplified in Exemplary embodiment 1.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A developer recovering unit comprising:

a recovery vessel that contains a developer to be recovered;

a transporting device that includes a transporting member that transports the developer through a tubular transport path connecting a portion where the developer is generated to the recovery vessel;

a detecting device that detects an amount of the developer contained in the recovery vessel, wherein the transporting member is formed as a conductive member and is grounded at least in a most downstream section of the transport path connected to the recovery vessel, wherein the transporting member has, in the most downstream section of the transport path, a conveyor rotating body that is supported by a bearing and rotated in the transport path, and the bearing is grounded and the conveyor rotating body is grounded through the bearing.

2. A developer recovering unit comprising:

a recovery vessel that contains a developer to be recovered;

a transporting device that includes a transporting member that transports the developer through a tubular transport path connecting a portion where the developer is generated to the recovery vessel;

a detecting device that detects an amount of the developer contained in the recovery vessel, an inside transporting member that is arranged inside the recovery vessel that transports the contained developer within the recovery vessel, wherein the inside transporting member is formed as a conductive member and is grounded, wherein the inside transporting member has an inside conveyor rotating body supported by a bearing and rotated, and the bearing is grounded and the conveyor rotating body is grounded through the bearing.

3. The developer recovering unit according to claim 2, wherein the transporting member is formed as a conductive member and is grounded at least in a most downstream section of the transport path connected to the recovery vessel.

4. The developer recovering unit according to claim 1, wherein at least a part of the transporting member is inserted into the recovery vessel in the most downstream section of the transport path connected to the recovery device.

5. An image forming apparatus comprising:

an imaging device that forms an image with a developer and transfers the image onto a recording medium; and a developer recovering unit that transports and recovers a part of the developer used in the imaging device to a recovery vessel, wherein the developer recovering unit includes:

the recovery vessel that contains the part of the developer to be recovered;

the transporting device that includes a transporting member for transporting the part of the developer through a tubular transport path connecting a portion where the developer is generated to the recovery vessel;

a detecting device that detects an amount of the developer contained in the recovery vessel, the transporting member is formed as a conductive member and is grounded at least in a most downstream section of the transport path connected to the recovery vessel, wherein the transporting member has, in the most downstream section of the transport path, a conveyor rotating body that is supported by a bearing and rotated in the transport path, and the bearing is grounded and the conveyor rotating body is grounded through the bearing.

6. The image forming apparatus according to claim 5, wherein at least a part of the transporting member is inserted into the recovery vessel in the most downstream section of the transport path connected to the recovery device.

7. The image forming apparatus according to claim 5,
wherein a supporting member on which the developer recovering unit is attached and supported is grounded, and
the transporting member of the transporting device to be grounded in the developer recovering unit is electrically connected to the supporting member.

8. The image forming apparatus according to claim 5,
wherein the transporting device of the developer recovering unit is fixed on a side of the image forming apparatus.

9. An image forming apparatus comprising:
an imaging device that forms an image with a developer and transfers the image onto a recording medium; and
a developer recovering unit that transports and recovers a part of the developer used in the imaging device to a recovery vessel,
wherein the developer recovering unit includes:
the recovery vessel that contains the part of the developer to be recovered;
the transporting device that includes a transporting member for transporting the part of the developer through a tubular transport path connecting a portion where the part of the developer is generated to the recovery vessel;
a detecting device that detects an amount of the developer contained in the recovery vessel; and
an inside transporting member that is arranged inside the recovery vessel for transporting the contained developer within the recovery vessel,
the inside transporting member is formed as a conductive member and is grounded,
wherein the transporting member has, in the most downstream section of the transport path, a conveyor rotating body that is supported by a bearing and rotated in the transport path, and
the bearing is grounded and the conveyor rotating body is grounded through the bearing.

10. The image forming apparatus according to claim 9,
wherein the transporting member is formed as a conductive member and is grounded at least in a most downstream section of the transport path connected to the recovery vessel.

11. The image forming apparatus according to claim 9,
wherein at least a part of the transporting member is inserted into the recovery vessel in the most downstream section of the transport path connected to the recovery device.

12. The image forming apparatus according to claim 9,
wherein the inside transporting member has an inside conveyor rotating body supported by a bearing and rotated, and
the bearing is grounded and the conveyor rotating body is grounded through the bearing.

13. The image forming apparatus according to claim 9,
wherein a supporting member on which the developer recovering unit is attached and supported is grounded, and
the inside transporting member to be grounded in the developer recovering unit is electrically connected to the supporting member.

14. The image forming apparatus according to claim 9,
wherein the transporting device of the developer recovering unit is fixed on a side of the image forming apparatus.

15. An image forming apparatus comprising:
an imaging device that forms an image with a developer and transfers the image onto a recording medium; and
a developer recovering unit that transports and recovers a part of the developer used in the imaging device to a recovery vessel,
wherein the developer recovering unit includes:
the recovery vessel that contains the part of the developer to be recovered;
the transporting device that includes a transporting member for transporting the part of the developer through a tubular transport path connecting a portion where the part of the developer is generated to the recovery vessel;
a detecting device that detects an amount of the developer contained in the recovery vessel; and
an inside transporting member that is arranged inside the recovery vessel for transporting the contained developer within the recovery vessel,
the inside transporting member is formed as a conductive member and is grounded,
wherein the inside transporting member has an inside conveyor rotating body supported by a bearing and rotated, and
the bearing is grounded and the conveyor rotating body is grounded through the bearing.

* * * * *